US009867417B2

(12) United States Patent
Beers et al.

(10) Patent No.: US 9,867,417 B2
(45) Date of Patent: Jan. 16, 2018

(54) ARTICLE WITH TENSIONING SYSTEM INCLUDING TENSION BALANCING MEMBER

(71) Applicant: NIKE, Inc., Beaverton, OR (US)

(72) Inventors: Tiffany A. Beers, Portland, OR (US); Nathan T. Gilbreath, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 436 days.

(21) Appl. No.: 14/468,795

(22) Filed: Aug. 26, 2014

(65) Prior Publication Data

US 2015/0047230 A1 Feb. 19, 2015

Related U.S. Application Data

(63) Continuation-in-part of application No. 13/939,208, filed on Jul. 11, 2013.

(51) Int. Cl.

| | |
|---|---|
| ***A43C 11/00*** | (2006.01) |
| ***A43B 1/00*** | (2006.01) |
| ***A43B 3/00*** | (2006.01) |
| ***A43B 11/00*** | (2006.01) |
| ***A43B 23/02*** | (2006.01) |
| ***A43C 11/16*** | (2006.01) |

(52) U.S. Cl.

CPC ..... *A43B 1/0018* (2013.01); *A43B 3/0005* (2013.01); *A43B 11/00* (2013.01); *A43B 23/027* (2013.01); *A43C 11/165* (2013.01)

(58) Field of Classification Search

CPC ..... A43C 11/00; A43C 11/16; A43C 11/165; A43B 3/0005; A43B 23/027; A43B 1/0018

USPC ..... 36/50.1, 97, 118.1, 50.5; 24/68 SK

See application file for complete search history.

(56) References Cited

U.S. PATENT DOCUMENTS

| | | | | |
|---|---|---|---|---|
| 4,000,566 A | | 1/1977 | Famolare, Jr. | |
| 4,270,285 A | | 6/1981 | Antonious | |
| 4,408,403 A | * | 10/1983 | Martin | A43C 11/1406 36/115 |
| 4,654,985 A | | 4/1987 | Chalmers | |

(Continued)

FOREIGN PATENT DOCUMENTS

| | | |
|---|---|---|
| GB | 2 256 574 A | 12/1992 |
| WO | 93/25107 A1 | 12/1993 |

(Continued)

OTHER PUBLICATIONS

International Preliminary Report on Patentability and Written Opinion of the International Searching Authority dated Jan. 21, 2016 in International Patent Application No. PCT/US2014/044480.

(Continued)

*Primary Examiner* — Sally Haden
*Assistant Examiner* — Jillian K Pierorazio
(74) *Attorney, Agent, or Firm* — Banner & Witcoff, Ltd.

(57) ABSTRACT

An article of footwear includes an intermediate covering portion with an adjustable volume. The intermediate covering portion is closed around the instep of the foot. The article also includes a tensioning system that can be used to change the volume of the intermediate covering portion. The tensioning system includes a tension balancing member to balance loads across different portions of the intermediate covering portion.

18 Claims, 33 Drawing Sheets

(56) References Cited

U.S. PATENT DOCUMENTS 4,811,503 A * 3/1989 Iwama ..... A43B 5/0447 36/118.1
4,969,278 A 11/1990 Ottieri
4,972,610 A 11/1990 Tong
5,205,055 A 4/1993 Harrell
5,325,613 A * 7/1994 Sussmann ..... A43C 11/00 24/712.2
5,570,522 A * 11/1996 Olson ..... A43C 11/008 36/115
5,791,068 A 8/1998 Bernier et al.
5,839,210 A 11/1998 Bernier et al.
5,934,599 A 8/1999 Hammerslag
6,032,387 A * 3/2000 Johnson ..... A43C 1/06 36/118.1
6,286,233 B1 * 9/2001 Gaither ..... A43C 1/00 36/50.1
6,378,230 B1 * 4/2002 Rotem ..... A43C 11/16 36/118.1
6,427,361 B1 8/2002 Chou
6,467,194 B1 * 10/2002 Johnson ..... A43C 1/06 36/118.1
6,691,433 B2 * 2/2004 Liu ..... A43B 3/0005 24/68 SK
6,896,128 B1 * 5/2005 Johnson ..... A43C 1/06 36/118.1
7,065,906 B2 6/2006 Jones et al.
7,096,559 B2 * 8/2006 Johnson ..... A43B 11/00 29/433
7,134,224 B2 * 11/2006 Elkington ..... A43B 5/0401 36/117.1
7,281,341 B2 * 10/2007 Reagan ..... A43B 3/0031 36/50.1
7,392,990 B2 7/2008 Bussiere
7,721,468 B1 * 5/2010 Johnson ..... A43C 1/06 36/118.1
7,752,774 B2 7/2010 Ussher
7,841,106 B2 * 11/2010 Farys ..... A43C 1/04 24/712.2
8,146,273 B2 4/2012 Sokolowski
8,387,282 B2 3/2013 Baker et al.
8,468,657 B2 6/2013 Soderberg et al.
8,844,167 B2 9/2014 Greene
D751,281 S 3/2016 Nickel et al.
9,375,052 B2 * 6/2016 Krueger ..... A43C 1/00
2004/0181972 A1 * 9/2004 Csorba ..... A43B 7/1495 36/50.1
2005/0076536 A1 4/2005 Hatfield et al.
2007/0033836 A1 2/2007 Rasmussen
2007/0039209 A1 2/2007 White et al.
2007/0186447 A1 8/2007 Ramos
2007/0209234 A1 9/2007 Chou
2007/0240334 A1 * 10/2007 Johnson ..... A43C 7/04 36/50.1
2008/0086911 A1 * 4/2008 Labbe ..... A43B 11/00 36/50.1
2008/0216351 A1 9/2008 Carroll et al.
2009/0000153 A1 1/2009 Grimmeisen
2010/0139057 A1 6/2010 Soderberg et al.
2011/0258876 A1 10/2011 Baker et al.
2012/0005923 A1 1/2012 Beers et al.
2012/0117821 A1 * 5/2012 Adams ..... A43B 3/0052 36/58.5
2012/0198727 A1 * 8/2012 Long ..... A43B 23/0235 36/25 R
2014/0070042 A1 3/2014 Beers et al.
2017/0215525 A1 * 8/2017 Labbe ..... A43C 11/165 36/97

FOREIGN PATENT DOCUMENTS

WO 2006/074067 A1 7/2006
WO 2009/071652 A1 6/2009

OTHER PUBLICATIONS

International Search Report and Written Opinion dated Nov. 7, 2014 in PCT/US2014/044480.
International Search Report and Written Opinion dated Jul. 31, 2015 in PCT/US2015/029401.

* cited by examiner

ARTICLE WITH TENSIONING SYSTEM INCLUDING TENSION BALANCING MEMBER

CROSS-REFERENCE TO RELATED APPLICATIONS

This application is a continuation-in-part of U.S. Pat. No. 9,609,918, filed as U.S. patent application Ser. No. 13/939,208, on Jul. 11, 2013, under the title "Article with Closed Instep Portion Having Variable Volume", the entirety of which is herein incorporated by reference. This application is also related to co-pending U.S. patent application Ser. No. 14/468,847 filed Aug. 26, 2014, and titled "Article with Tensioning System Including Driven Tensioning Members," the entirety of which is herein incorporated by reference.

BACKGROUND

The present embodiments relate generally to articles of footwear, and in particular to an article of footwear with tensioning systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

SUMMARY

In one aspect, an article of footwear includes an upper with a toe covering portion and an entry hole for receiving a foot. The upper includes an intermediate covering portion disposed between the toe covering portion and the entry hole, where the intermediate covering portion is closed around the instep of the foot and wherein the volume of the intermediate covering portion is variable. The article further includes a first tensioning member having a first portion, a second portion and a third portion, where the first portion extends through the intermediate covering portion, the third portion extends through the intermediate covering portion and the second portion is disposed between the first portion and the second portion. The article further includes a second tensioning member with a first end portion associated with a tension balancing member and the second tensioning member has a second end portion. The second portion of the first tensioning member is engaged with the tension balancing member such that the second portion can move with respect to the tension balancing member. Increasing the tension of the second tensioning member results in increased tension in the first tensioning member, which substantially decreases the volume of the intermediate covering portion.

In another aspect, an article of footwear includes an upper having a toe covering portion and an entry hole for receiving a foot and an intermediate covering portion disposed between the toe covering portion and the entry hole, where the intermediate covering portion is closed around the instep of the foot and where the volume of the intermediate covering portion is variable. The article also includes a reel based tensioning device, a first tensioning member extending through the intermediate covering portion and a second tensioning member with a first end portion configured as a loop portion and a second end portion associated with the reel based tensioning device. The first tensioning member is disposed through the loop portion such that the first tensioning member can translate through the loop portion. The loop portion transfers tension between the first tensioning member and the second tensioning member. The volume of the intermediate covering portion is decreased when the reel based tensioning device is actuated to increase tension in the second tensioning member.

In another aspect, an article of footwear includes an upper including a closed instep portion. The article includes a tensioning system that has: a first driven tensioning member associated with a first side of the upper and a first driving tensioning member associated with the first side, where the first driving tensioning member is attached to the instep portion; and a second driven tensioning member associated with a second side of the upper and a second driving tensioning member associated with the second side, where the second driving tensioning member is attached to the instep portion. A first end portion of the first driving tensioning member is associated with a first tension balancing member and the first driven tensioning member is engaged with the first tension balancing member. The first tension balancing member can transfer tension between the first driving tensioning member and the first driven tensioning member and the first driven tensioning member can move with respect to the first tension balancing member. A first end portion of the second driving tensioning member is associated with a second tension balancing member, and the second driven tensioning member is engaged with the second tension balancing member. The second tension balancing member can transfer tension between the second driving tensioning member and the second driven tensioning member. The second driven tensioning member can move with respect to the second tension balancing member. A second end portion of the first driving tensioning member is attached to a tensioning device and a second end portion of the second driving tensioning member is attached to the tensioning device. Increasing the tension in the first driving tensioning member and the second driving tensioning member using the tensioning device pulls the first driven tensioning member and the second driven tensioning member and pulling the first driven tensioning member and the second driven tensioning member fastens the instep portion of the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

FIGS. 1 through 4 illustrate schematic isometric views of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Figure 1:
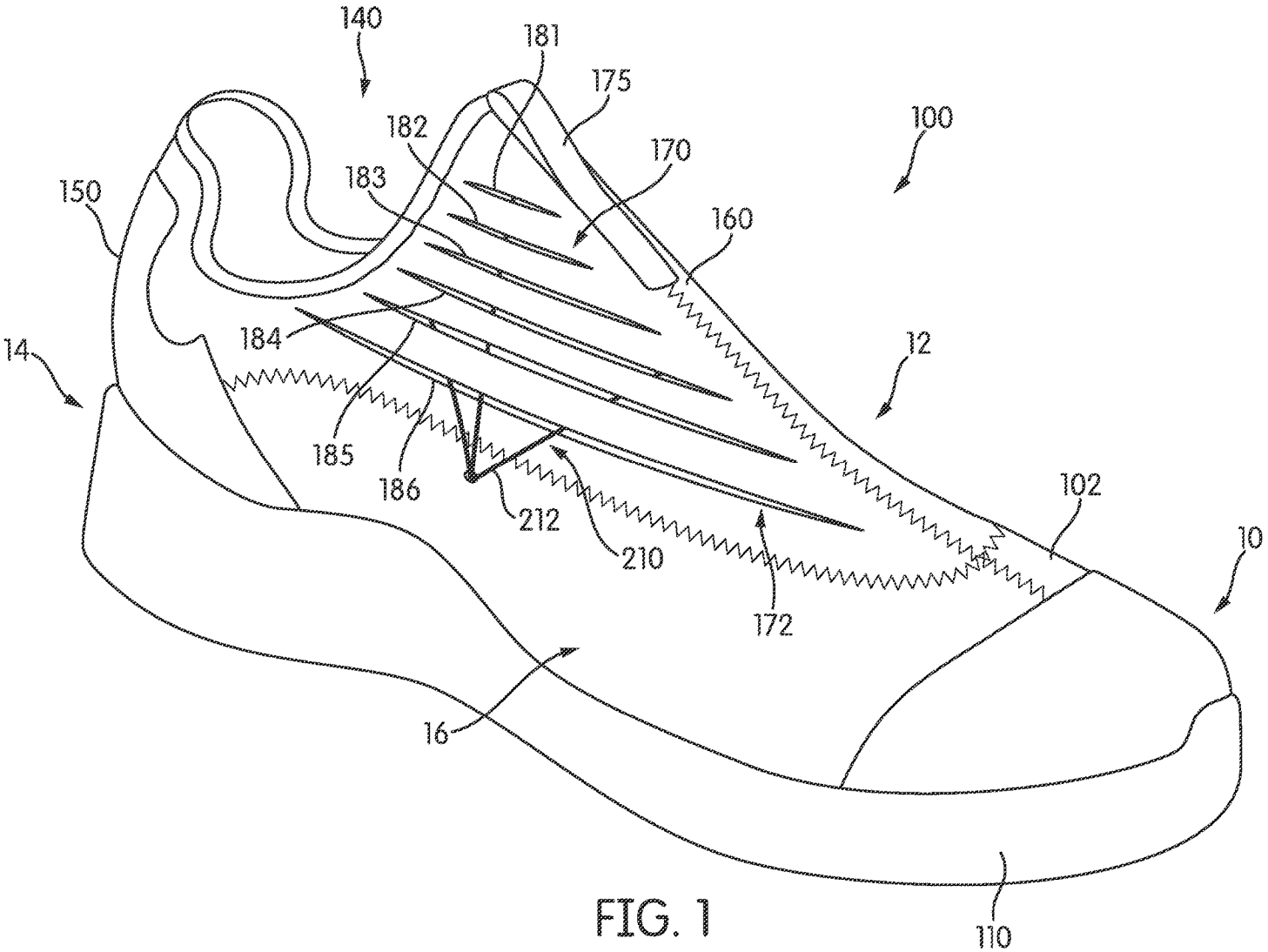
FIG. 1 is a lateral isometric view of an embodiment of an article of footwear.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see FIG. 3). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing individual components of an article, such as an upper and/or a sole structure.

Referring to FIGS. 1 through 4, article 100 may include an upper 102 as well as a sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 120 and outsole 122. As discussed in further detail below, some embodiments may include sole structures with internal cavities or recesses for receiving various components, for example a cavity for receiving an electronic device.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Figure 3:
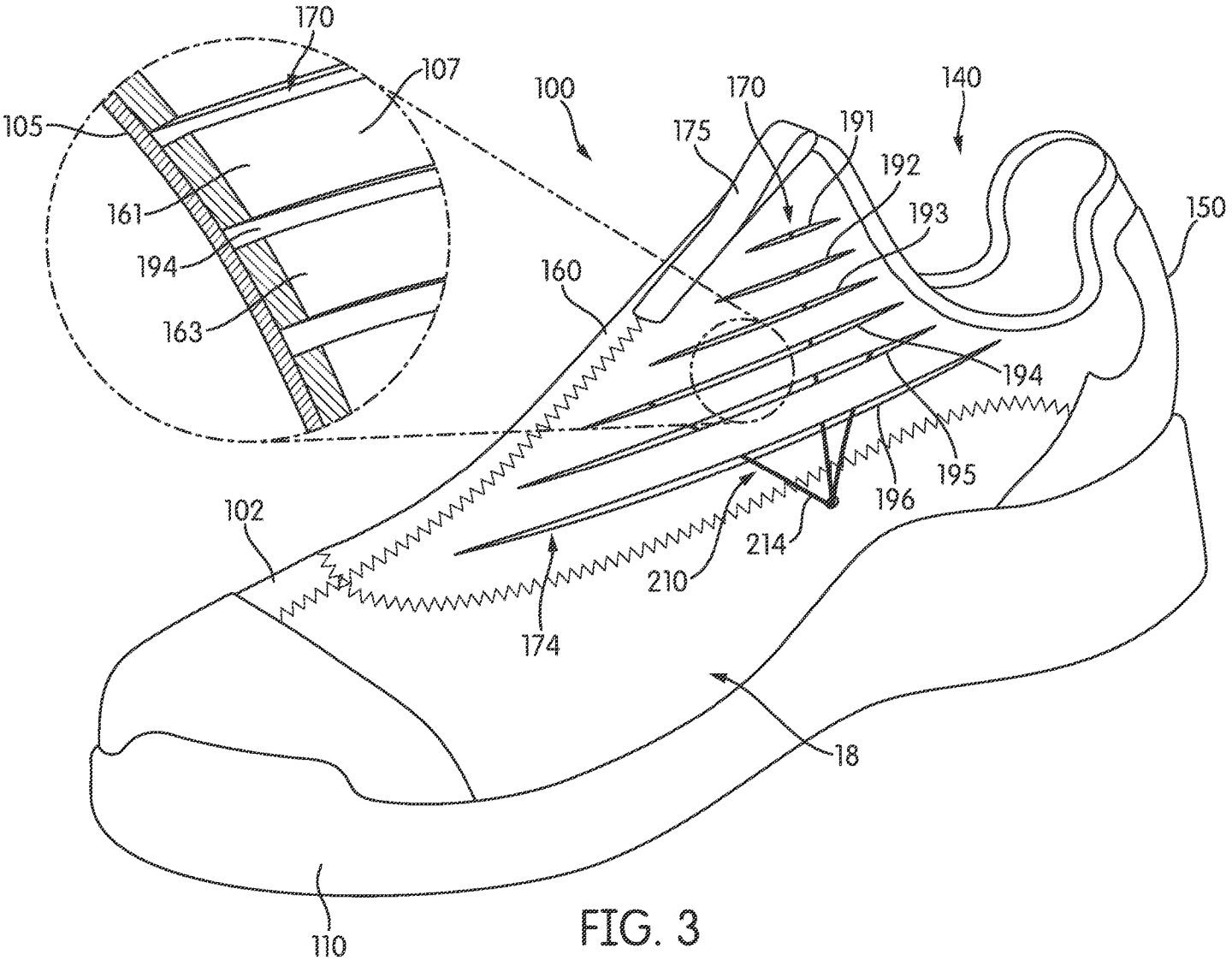
FIG. 3 is a medial isometric view of an embodiment of an article of footwear.

In different embodiments, the material construction of upper 102 could vary. In some embodiments, upper 102 may comprise a single base layer of material, such as, for example, a synthetic material layer. In other embodiments, however, upper 102 could comprise two or more material layers. As seen in FIG. 3, in some embodiments, upper 102 may be constructed with an inner layer 105 and an outer layer 107. In some embodiments, inner layer 105 could be substantially more elastic than outer layer 107. In other cases, however, inner layer 105 could be less elastic and/or have a similar elasticity to outer layer 107. In some embodiments, inner layer 105 could be a mesh layer, while outer layer 107 could be a foam layer. In some embodiments, the foam material of outer layer 107 may be less elastic than mesh material of inner layer 105.

In some embodiments, upper 102 includes opening 140 that provides entry for the foot into an interior cavity of upper 102. Opening 140 may be bounded from a rearward direction by heel portion 150 of upper 102. In some embodiments, upper 102 further includes an instep portion 160 that corresponds to the top of a foot.

In contrast to some other upper configurations, article 100 may generally be closed along the top of upper 102, including along instep portion 160. In other words, instep portion 160 may be configured as a closed portion. In particular, instep portion 160 may be closed around the instep of a foot, when a foot has been inserted into article 100.

For purposes of clarity, the term "intermediate covering portion" is used throughout this detailed description and in the claims to refer to a portion of an upper corresponding to an instep of the foot and surrounding parts of the foot. In some embodiments, the intermediate covering portion may include portions of the vamp, but not necessarily all of the vamp. Moreover, the intermediate covering portion described herein is most generally characterized as including the portions of the upper between a toe portion of the upper and an entry hole or opening of the upper.

Figure 5:
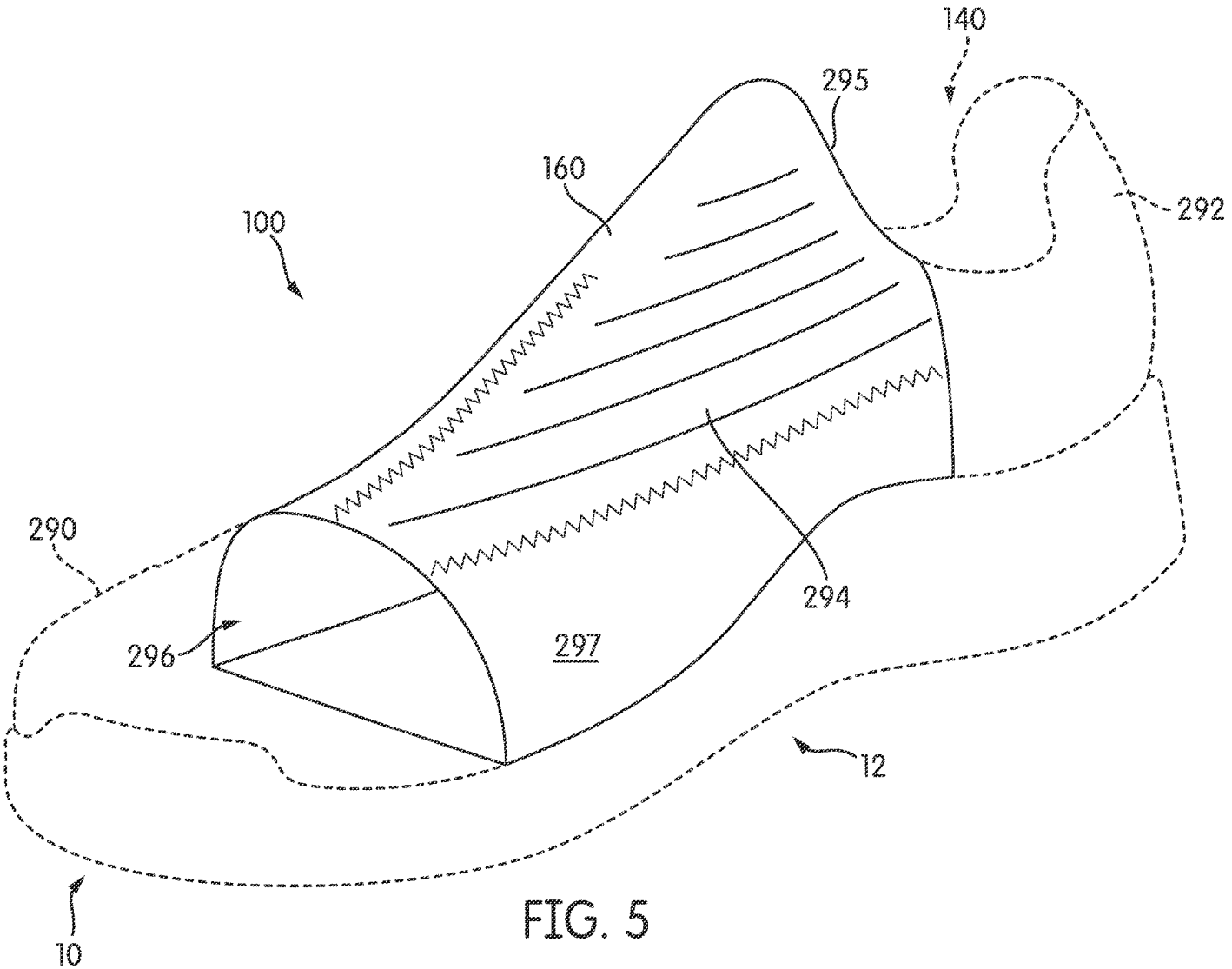
FIG. 5 is a schematic isometric view of an embodiment of an article of footwear, in which an intermediate covering portion is clearly depicted.

FIG. 5 illustrates a schematic view of an embodiment of article 100, in which an intermediate covering portion of article 100 has been highlighted. Referring to FIG. 5, article 100 may be characterized as having a toe covering portion 290, a rearward covering portion 292 and an intermediate covering portion 294 disposed between the toe covering portion 290 and the rearward covering portion 292. In FIG. 5, toe covering portion 290 and rearward covering portion 292 are indicated in phantom, while intermediate covering portion 294 is indicated with solid lines. In some embodiments, intermediate covering portion 294 may be bounded in a rearward direction by a forward edge 295 of opening 140. Moreover, intermediate covering portion 294 may include portions of forefoot portion 10 and/or midfoot portion 12. Further, intermediate covering portion 294 can include some or all of instep portion 160. Thus, in some embodiments, intermediate covering portion 294 generally covers the part of a foot forwards of the ankle and rearwards of the toes.

In some embodiments, intermediate covering portion 294 may generally define a volume 296, whose boundaries are associated with a surface 297 defined by intermediate covering portion 294. As portions of article 100 are expanded and contracted in response to changes in tension of various tensioning members, volume 296 may generally change accordingly. Thus, for example, as portions of article 100 contract with increased tension of tensioning system 200, volume 296 may decrease. Likewise, as portions of article 100 expand with decreased tension of tensioning system 200, volume 296 may increase.

In order to facilitate entry of a foot into upper 102, intermediate covering portion 294 may include provisions for expanding and contracting, especially at instep portion 160, which may be part of intermediate covering portion 294. In some embodiments, instep portion 160 may be configured with a plurality of channels 170 to facilitate expansion of instep portion 160, or more intermediate covering portion 294, as described in further detail below. In some embodiments, plurality of channels 170 further includes a first group of channels 172 and a second group of channels 174, associated with the lateral side 16 and medial side 18, respectively, of upper 102.

Referring to FIG. 1, in some embodiment, first group of channels 172 further comprises a first channel 181, a second channel 182, a third channel 183, a fourth channel 184, a fifth channel 185 and a sixth channel 186. Likewise, as seen in FIG. 3, second group of channels 174 further comprises a first channel 191, a second channel 192, a third channel 193, a fourth channel 194, a fifth channel 195 and a sixth channel 196. In some cases, the channels of first group of channels 172 and second group of channels 174 may be in one to one correspondence. For example, in some cases, first channel 181 of first group of channels 172 may correspond with first channel 191 of second group of channels 174. In particular, first channel 181 and first channel 191 may both have similar relative locations on lateral side 16 and medial side 18, respectively, of instep portion 160. Likewise, first channel 181 and first channel 191 could have substantially similar sizes and/or orientations on instep portion 160. In other embodiments, however, the channels of first group of channels 172 may not be in one to one correspondence with channels of second group of channels 174. For example, in other embodiments, instep portion 160 could include six channels on lateral side 16 and five channels on medial side 18.

In different embodiments, the depths of plurality of channels 170 relative to the material thickness of upper 102 can vary. In some embodiments, for example, plurality of channels 170 may be configured as channels extending through the entire thickness of upper 102. In other embodiments, however, plurality of channels 170 may not extend through the entire thickness of an upper material. In some embodiments, as seen in FIG. 3, plurality of channels 170 may extend through outer layer 107, but not through inner layer 105, of upper 102. Thus, plurality of channels 170 may generally separate adjacent segments of material in outer layer 107. For example, fourth channel 194 is seen to separate section 161 of outer layer 107 from section 163 of outer layer 107. With this arrangement, as upper 102 is stretched along instep portion 160, inner layer 105 may stretch accordingly, with adjacent sections of outer layer 107 further separating as plurality of channels 170 expand.

Figure 8:
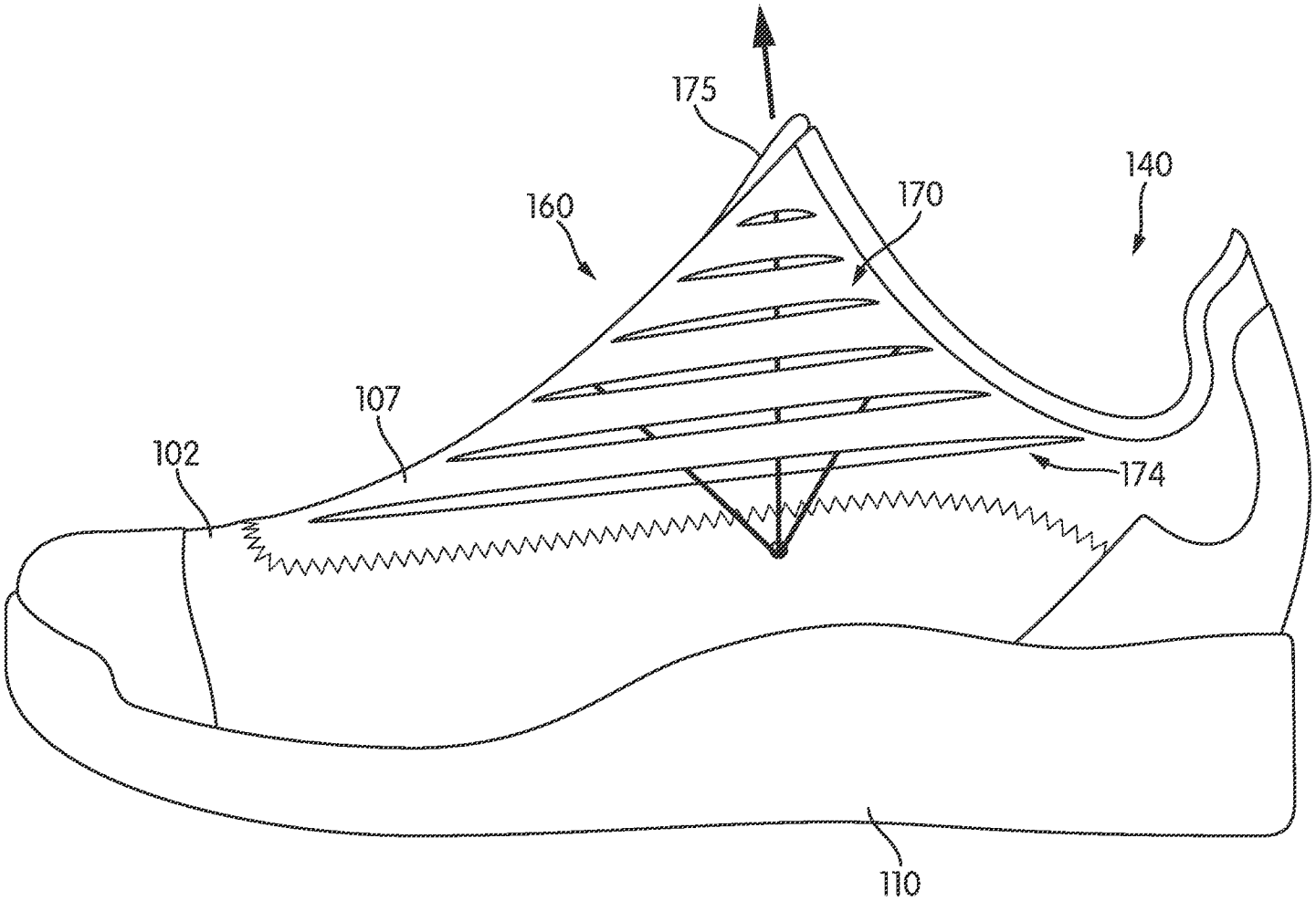
FIG. 8 is a side view of an embodiment of an article of footwear in which an instep portion undergoes expansion.

In different embodiments, the orientations of plurality of channels 170 could vary. In some embodiments, the channels comprising first group of channels 172 may be generally parallel to one another. In addition, in some cases, the channels comprising first group of channels 172 may be approximately oriented in the longitudinal direction. In a similar manner, in some embodiments, the channels comprising second group of channels 174 may be generally parallel and oriented approximately in the longitudinal direction. This general configuration for plurality of channels 170 on instep portion 160 may facilitate the expansion of instep portion 160, and of intermediate covering portion 294 more generally, in a direction that is generally perpendicular with the lengthwise orientations of plurality of channels 170. More specifically, as plurality of channels 170 expand along a widthwise direction of the channels that is generally perpendicular to the longitudinal direction of upper 102, instep portion 160 may expand in a direction approximately parallel to that widthwise direction. Such an expanded configuration is shown in FIG. 8 and described in further detail below. Moreover, as discussed further below, the expansion of plurality of channels 170 may result in a net increase in volume for portions of article 100, including for instance, an increase in the volume of instep portion 160 and of intermediate covering portion 294.

Some embodiments may include tab portion 175. In some embodiments, tab portion 175 is a tab-like portion disposed along the top of instep portion 160. In some embodiments, tab portion 175 has a looped geometry that can be easily grasped with a finger. In some cases, tab portion 175 may be disposed adjacent to opening 140. Tab portion 175 may be grasped and pulled by a user to expand instep portion 160. This allows opening 140 to increase in size temporarily, thereby permitting entry of a foot through opening 140. With tab portion 175 released, instep portion 160 may return to a pre-tensioned size and/or volume.

Embodiments can include provisions to facilitate contracting instep portion 160 (and thereby reducing its volume) once a foot has been inserted in order to tighten the fit of upper 102 to the foot. In some embodiments, article 100 may include tensioning system 200 (indicated in FIGS. 2 and 4) that may provide tension across instep portion 160. Tensioning system 200 may further comprise one or more tensioning members as well as a tensioning device. Examples of possible tensioning members that could be used include, but are not limited to: cables, wires, strings, laces, straps, belts, ribbons, chains as well as any other kinds of tensioning members. Moreover, exemplary tensioning devices include, but are not limited to: winding devices (e.g., reels and spools), springs, as well as any other devices, systems or components that can be used to apply tension to any portion of a tensioning member.

In some embodiments, tensioning system 200 may include plurality of tensioning members 210. Plurality of tensioning members 210 may comprise cable-like or wire-like members. In particular, the tensioning members of the current embodiment may be characterized as being approximately one-dimensional. In other words, each tensioning member may generally have a length that is substantially greater than the width, thickness and/or diameter of the tensioning member. In other embodiments, however, one or more tensioning members could be approximately two-dimensional members (e.g., ribbons, belts or straps).

Figure 2:
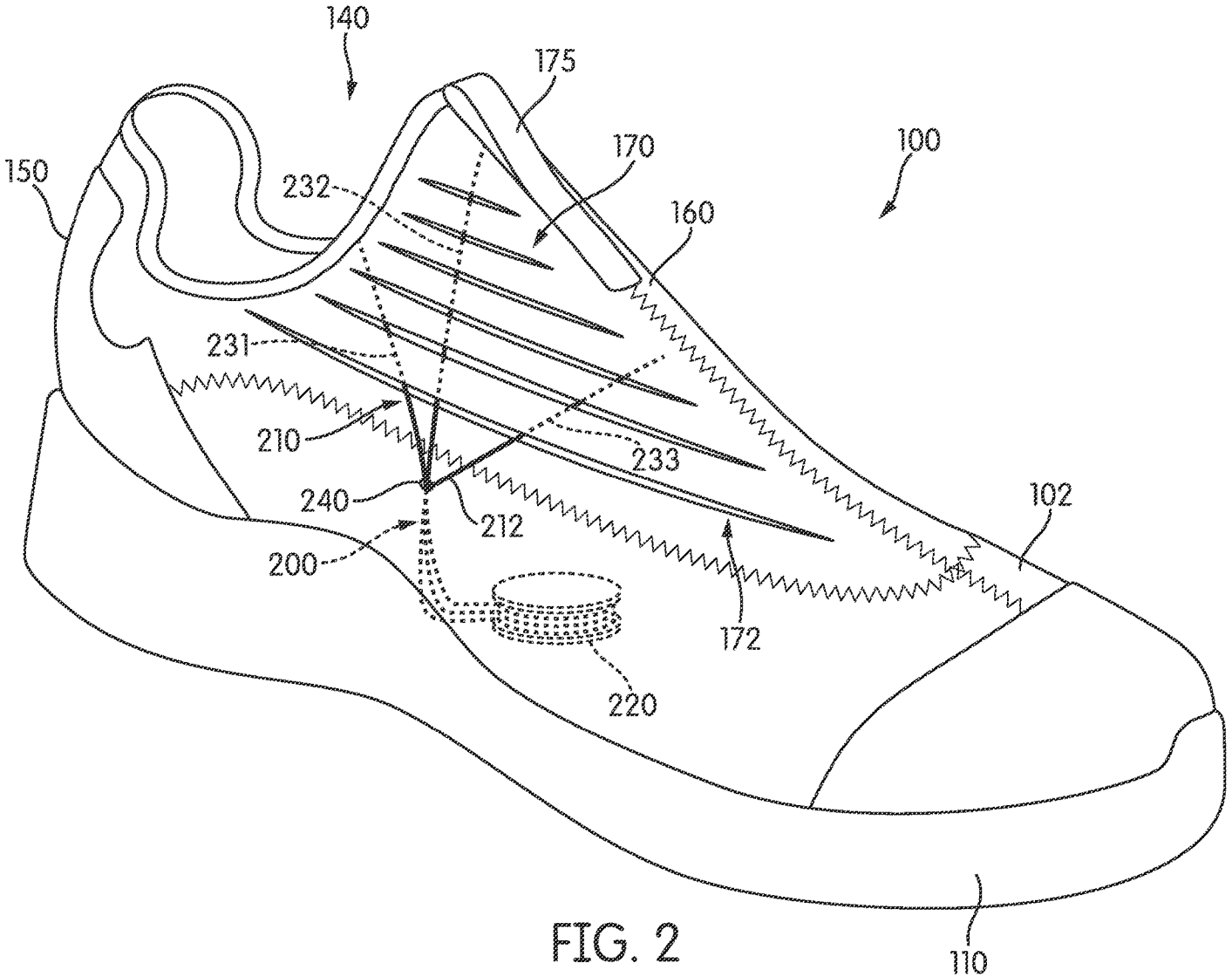
FIG. 2 is a lateral isometric view of an embodiment of an article of footwear including portions of a tensioning system shown in phantom.
Figure 4:
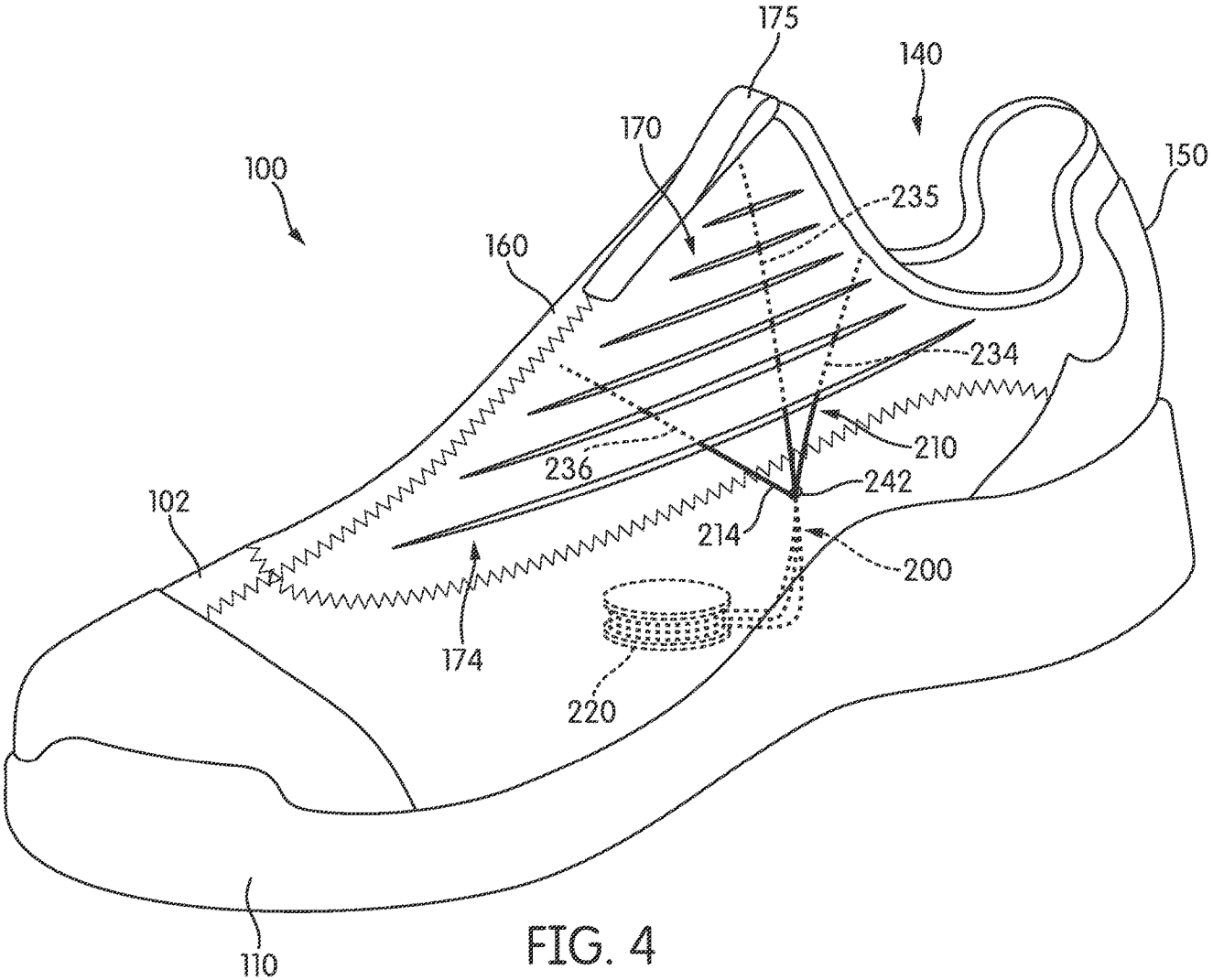
FIG. 4 is a medial isometric view of an embodiment of an article of footwear including portions of a tensioning system shown in phantom.

Plurality of tensioning members 210 may be further grouped into a first group of tensioning members 212 and a second group of tensioning members 214, which are associated with lateral side 16 and medial side 18, respectively, of upper 102. Generally, each group could have any number of tensioning members. In some embodiments, first group of tensioning members 212 and second group of tensioning members 214 may each comprise three distinct tensioning members. However, other embodiments could include any other number of tensioning members in each group of tensioning members, including one, two, three, four or more than four tensioning members. In particular, as seen in FIG. 2, first group of tensioning members 212 may include first tensioning member 231, second tensioning member 232 and third tensioning member 233. Likewise, as seen in FIG. 4, second group of tensioning members 214 may include fourth tensioning member 234, fifth tensioning member 235 and sixth tensioning member 236.

Tensioning system 200 further includes tensioning device 220 that may be used to adjust the tension in plurality of tensioning members 210. For purposes of clarity, tensioning device 220 is shown schematically in the current embodiments. However, tensioning device 220 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Patent Application Publication Number 2010/0139057, now U.S. patent application Ser. No. 12/623,362, filed Nov. 20, 2009 and titled "Reel Based Lacing System", the entirety of which is hereby incorporated by reference. Examples of a motorized tensioning device that could be used with the current embodiments are disclosed in Beers, U.S. Patent Publication Number 2014/0070042, published Mar. 13, 2014, and filed as U.S. patent application Ser. No. 14/014,555, on Aug. 30, 2013, and titled "Motorized Tensioning System with Sensors", the entirety being incorporated by reference herein. In an exemplary embodiment, tensioning device 220 could be a reel-based tensioning device that winds the tensioning members onto a reel to increase the tension.

In different embodiments, the location of tensioning device 220 could vary. In some embodiments, tensioning device 220 could be disposed in a portion of upper 102. In some embodiments, as shown in FIGS. 2 and 4, tensioning device 220 could be disposed in a portion of sole structure 110. In particular, in some cases, tensioning device 220 could be embedded within an internal cavity of sole structure 110. For purposes of clarity, the location of tensioning device 220 is shown schematically in the figures, but it will be appreciated that any method known in the art for incorporating various rigid components and devices into a sole and/or upper can be used.

Referring now to FIG. 2, the tensioning members of tensioning system 200 may generally extend from tensioning device 220 in sole structure 110 to portions of upper 102. For example, first tensioning member 231, second tensioning member 232 and third tensioning member 233 may extend from tensioning device 220, travel through and exit sole structure 110 and enter upper 102. In some embodiments, portions of each tension member may travel internally to upper 102, either along an inner side surface of upper 102, or between adjacent layers of upper 102 (such as between outer layer 107 and inner layer 105). First tensioning member 231, second tensioning member 232 and third tensioning member 233 may generally exit upper 102 at aperture 240. From aperture 240, first tensioning member 231, second tensioning member 232 and third tensioning member 233 may travel through instep portion 160. As discussed in further detail below, in some embodiments, first tensioning member 231, second tensioning member 232 and third tensioning member 233 may extend generally adjacent to one another from tensioning device 220 to aperture 240, but may separate and extend in various different directions upon exiting aperture 240. This arrangement allows lateral side 16 of instep portion 160 to be contracted by applying tension to first group of tensioning members 212 using tensioning device 220.

Referring now to FIG. 4, in some embodiments, fourth tensioning member 234, fifth tensioning member 235 and sixth tensioning member 236 may be configured in a similar manner to first tensioning member 231, second tensioning member 232 and third tensioning member 233. That is, fourth tensioning member 234, fifth tensioning member 235 and sixth tensioning member 236 may extend from tensioning device 220, travel through and exit sole structure 110 and enter upper 102. Each tensioning member may extend through a portion of upper 102 and exit upper 102 at aperture 242 on medial side 18. From aperture 242, fourth tensioning member 234, fifth tensioning member 235 and sixth tensioning member 236 may extend through instep portion 160. This arrangement allows medial side 18 of instep portion 160 to be contracted by applying tension to second group of tensioning members 214 using tensioning device 220.

Figure 6:
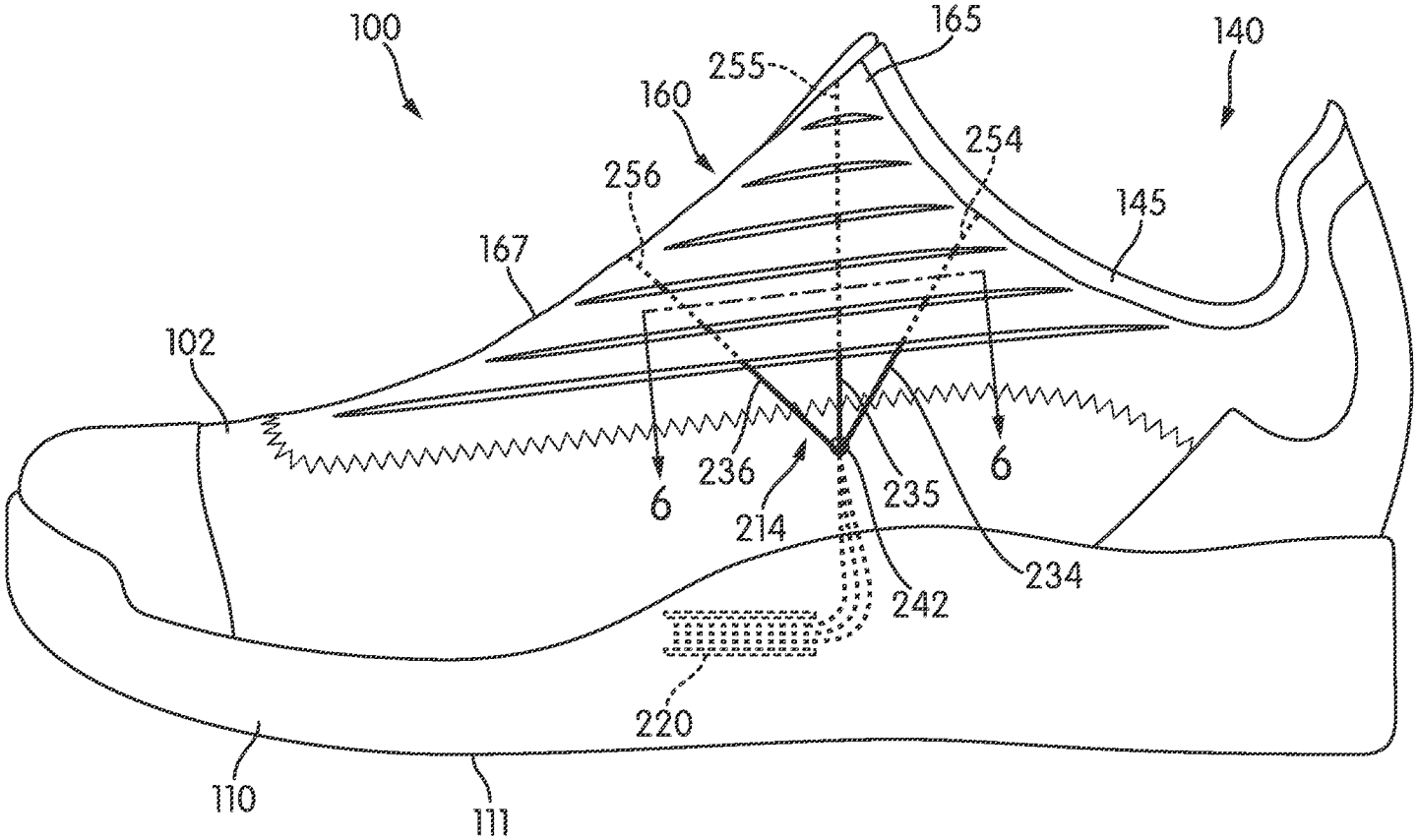
FIG. 6 is a side view of an embodiment of an article of footwear including a tensioning system for adjusting the volume of an instep portion.

FIG. 6 illustrates a medial side view of article 100. Referring to FIG. 6, the configuration of second group of tensioning members 214 along instep portion 160 can be clearly seen. In particular, after exiting aperture 242, fourth tensioning member 234, fifth tensioning member 235 and sixth tensioning member 236 each extend towards the top of instep portion 160. Moreover, the tensioning members generally spread out in a radial direction from aperture 242. In some embodiments, fourth tensioning member 234 extends from aperture 242 to a periphery 145 of opening 140. Periphery 145 may be seen to bound instep portion 160 from the rearward direction. In some cases, an end portion 254 of fourth tensioning member 234 may be secured, or otherwise anchored, to a point along periphery 145. Likewise, fifth tensioning member 235 extends from aperture 242 to a top portion 165 of instep portion 160 that is generally vertically furthest from a lower surface 111 of sole structure 110. In some cases, an end portion 255 of fifth tensioning member 235 may be secured, or otherwise anchored, to top portion 165 of instep portion 160. In addition, sixth tensioning member 236 extends from aperture 242 to an upper forward portion 167 of instep portion 160. In some cases, an end portion 256 of sixth tensioning member may be secured, or otherwise anchored, to upper forward portion 167 of instep portion 160.

It will be understood that tensioning members of first group of tensioning members 212 may be configured in a similar manner on lateral side 16 of article 100. In particular, first tensioning member 231, second tensioning member 232 and third tensioning member 233 may extend outwardly from aperture 240 in a similar manner to fourth tensioning member 234, fifth tensioning member 235 and sixth tensioning member 236. In some embodiments, this arrangement may provide substantially symmetric tension along the lateral and medial sides of instep portion 160, thereby allowing tension to be applied in a generally symmetric manner. In other embodiments, however, first group of tensioning members 212 and second group of tensioning members 214 need not be arranged in a symmetric manner.

Figure 7:
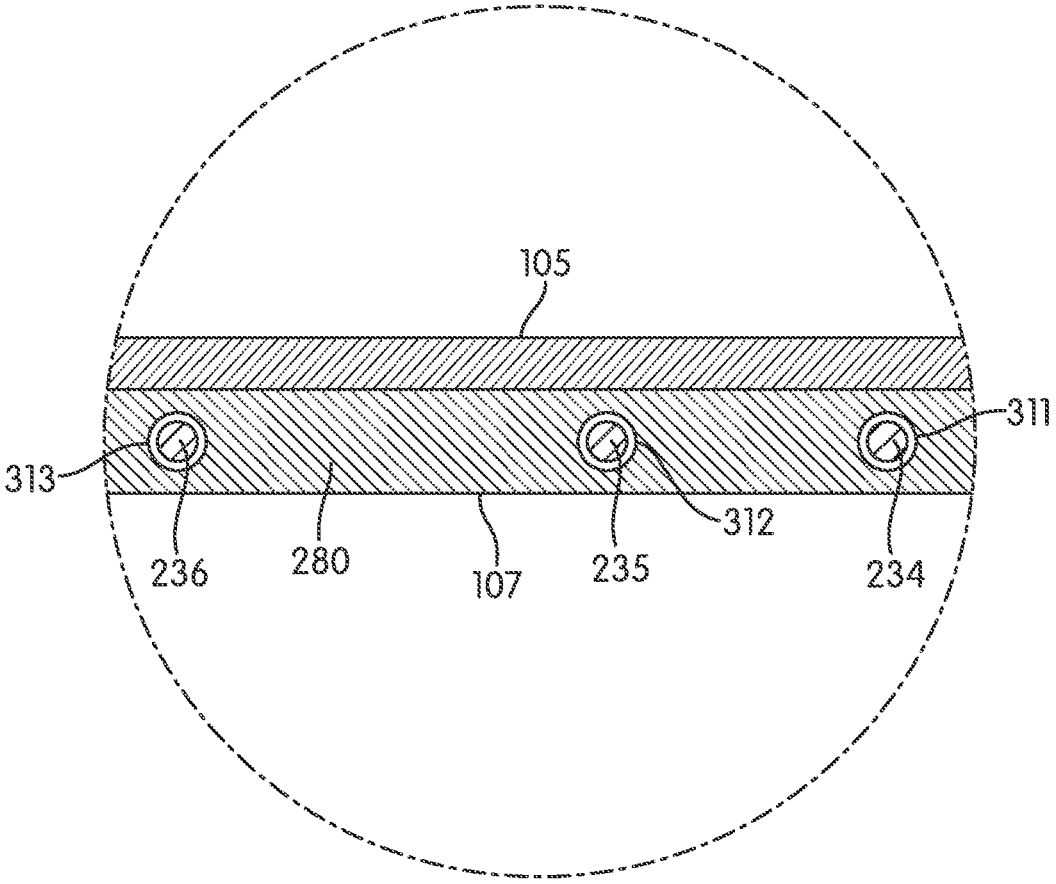
FIG. 7 is an enlarged cross-sectional view of an embodiment of an inner layer and an outer layer of an upper.

FIG. 7 is a cross-sectional view of a portion of upper 102, in which the layered structure of upper 102 is clearly seen. As seen in FIG. 7, in some embodiments one or more tensioning members may extend through cavities within outer layer 107. For example, in the current embodiment fourth tensioning member 234, fifth tensioning member 235 and sixth tensioning member 236 may extend through a first cavity 311, a second cavity 312 and third cavity 313, respectively. First cavity 311, second cavity 312 and third cavity 313 may be formed in a segment 280 of outer layer 107, which may be a segment disposed between adjacent channels of instep portion 160. In some embodiments, other portions of outer layer 107 may also include cavities to receive portions of each tensioning member. Using this arrangement, each tensioning member of second group of tensioning members 214 may be guided through instep portion 160 in a desired configuration.

With respect to tensioning members and the layers of upper 102, it will be understood that other arrangements are possible. In some other embodiments, one or more tensioning members could extend between outer layer 107 and inner layer 105. In still other embodiments, one or more tensioning members could extend externally to outer layer 107. In still other embodiments, one or more tensioning members could extend along an inner side of inner layer 105 (i.e., directly adjacent to a foot). In such an embodiment, tubes or other guides may be used to facilitate cushioning between the tensioning members and the foot.

Some embodiments could incorporate one or more internal and/or external guides that facilitate the alignment and travel of tensioning members. In some embodiments, one or more guides could be disposed within cavities of outer layer 107. In other embodiments, guides could be used to house portions of tensioning members that extend between cavities in adjacent sections of material. The use of guides, such as tubes, may further facilitate alignment of tensioning members and allow for smoother travel of the tensioning members. Such provisions, as well as the presence of inner layer 105, could also reduce the tendency of the tensioning members to apply unwanted pressures directly to the foot.

FIG. 8 illustrates a side view of article 100, in which instep portion 160 is undergoing expansion. As seen in FIG. 8, tension may be applied to tab portion 175 to expand instep portion 160. In particular, as tension is applied to instep portion 160, plurality of channels 170 (including second group of channels 174) expand as adjacent segments of outer layer 107 are separated from one another. As previously discussed, plurality of channels 170 may generally expand in along their width, which is generally perpendicular to the longitudinal direction of article 100. This expansion in the volume of instep portion 160 may increase the size of opening 140. This temporary increase in the size of opening 140 allows a user to easily insert their foot into upper 102.

Figure 9:
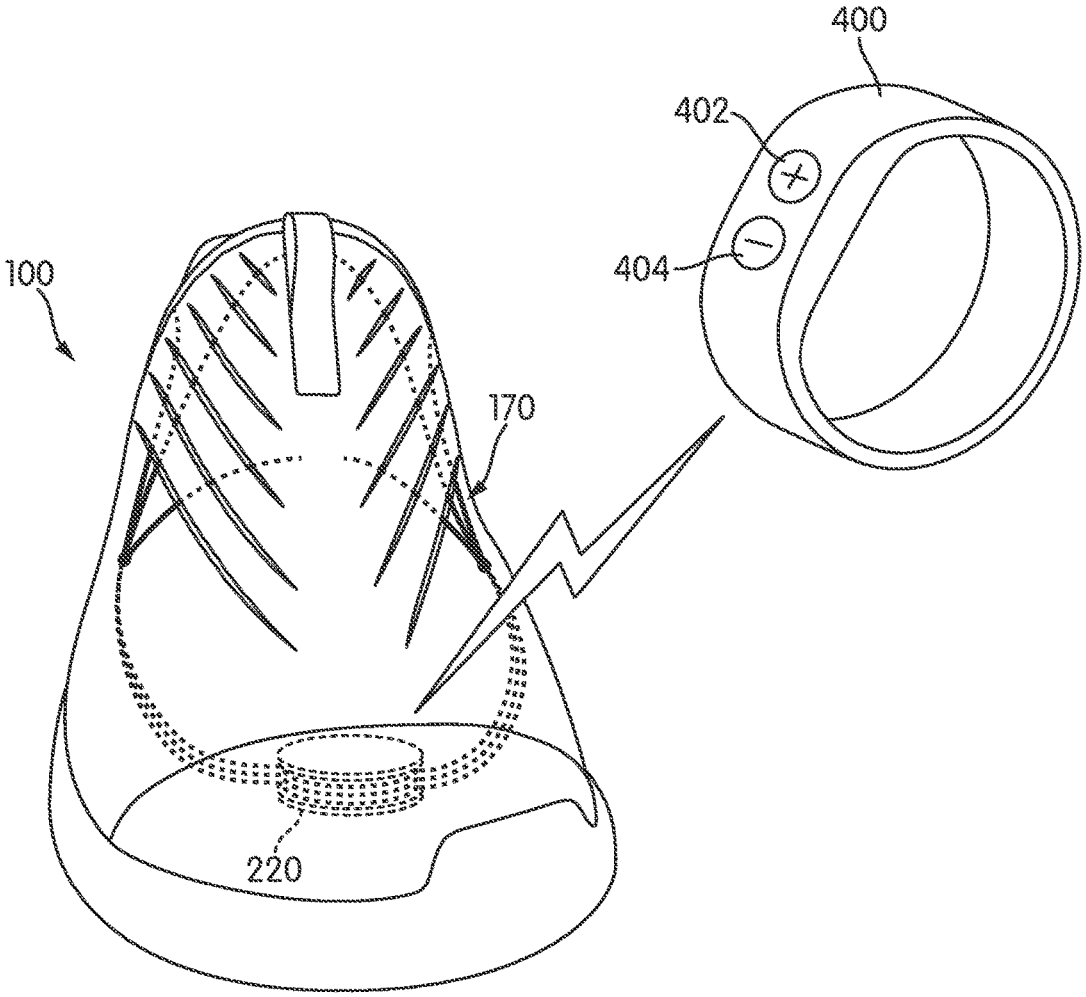
FIG. 9 is a schematic view of an embodiment of an article including a tensioning system and a remote device configured to operate the tensioning system.

FIG. 9 illustrates a schematic view of article 100 and a remote device 400. Remote device 400 may be in communication with tensioning device 220. In some embodiments, remote device 400 can include provisions that allow a user to remotely adjust the tension applied by tensioning device 220. In one embodiment, remote device 400 may include a tightening button 402 (indicated in FIG. 9 as a "plus" symbol) and a loosening button 404 (indicated in FIG. 9 as a "minus" symbol). This allows a user to adjust the tension by pressing tightening button 402 and/or loosening button 404. It will be understood that the tension could be adjusted in discrete steps (i.e., an incremental adjustment in tension each time a button is pressed) or could occur continuously (i.e., the tension is continuously adjusted as long as a button remains depressed).

In the current embodiment, remote device 400 is shown as a bracelet that may be worn by a user. In other embodiments, however, remote device 400 could be any other kind of device. Examples of other remote devices that could be used to communicate with tensioning device 220 include, but are not limited to: cell phones, smart phones, tablets, various kinds of remote control devices as well as any other kinds of remote devices. Moreover, a remote device can communicate with tensioning device 220 using any communication method including, but not limited to: radio signals, infra-red signals, as well as any other kinds of communication signals known in the art.

It will be understood that while the embodiments of the figures illustrate a tensioning system that uses a single tensioning device, other embodiments could incorporate two or more tensioning devices. In still another embodiment, for example, an article could include a separate tensioning device on each of the lateral and medial sides of the article. This alternative configuration could facilitate independent tensioning of tensioning members associated with the lateral and medial sides.

Figure 10:
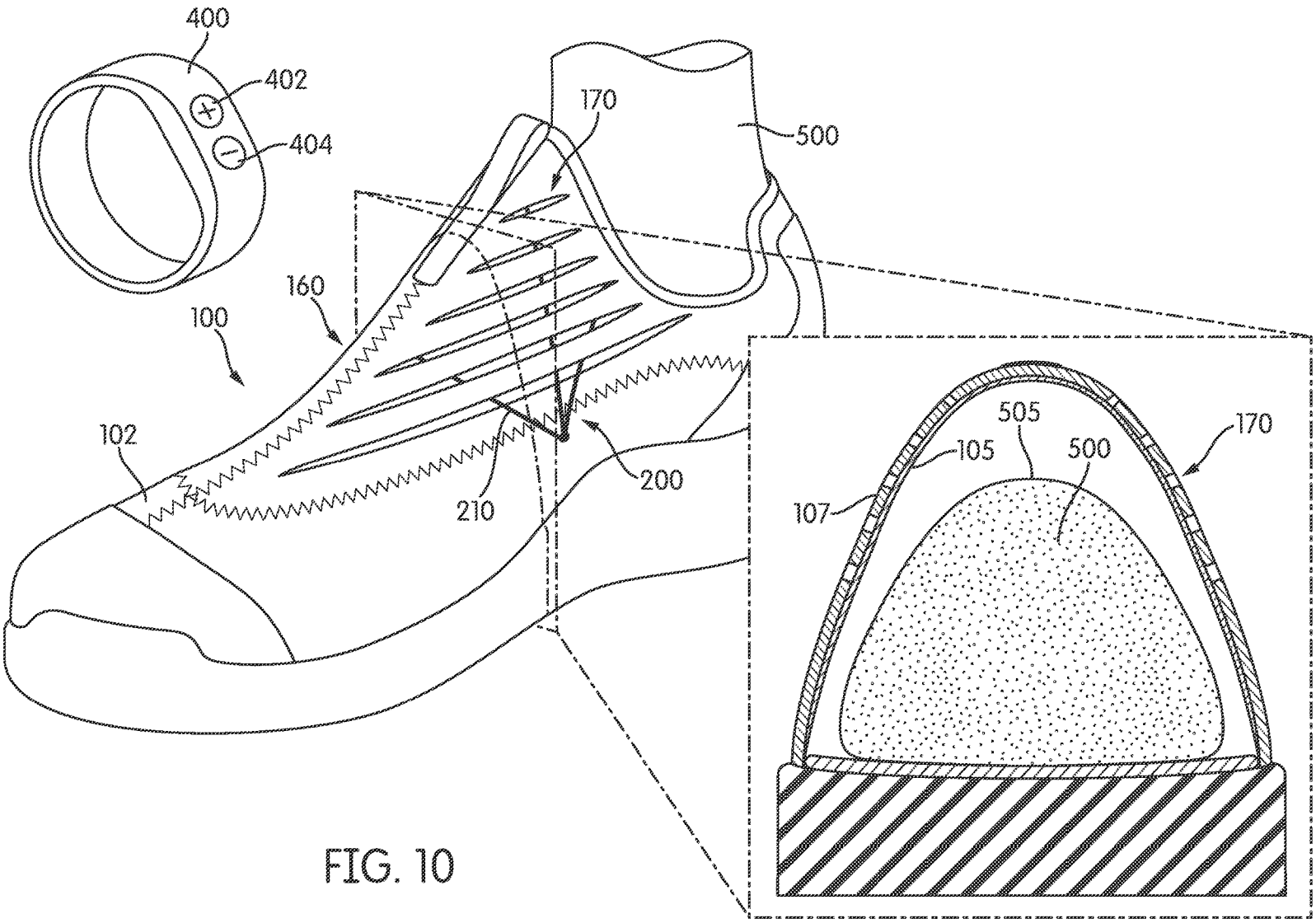
FIG. 10 is a schematic view of an embodiment of an article of footwear with a foot inserted into an upper.
Figure 11:
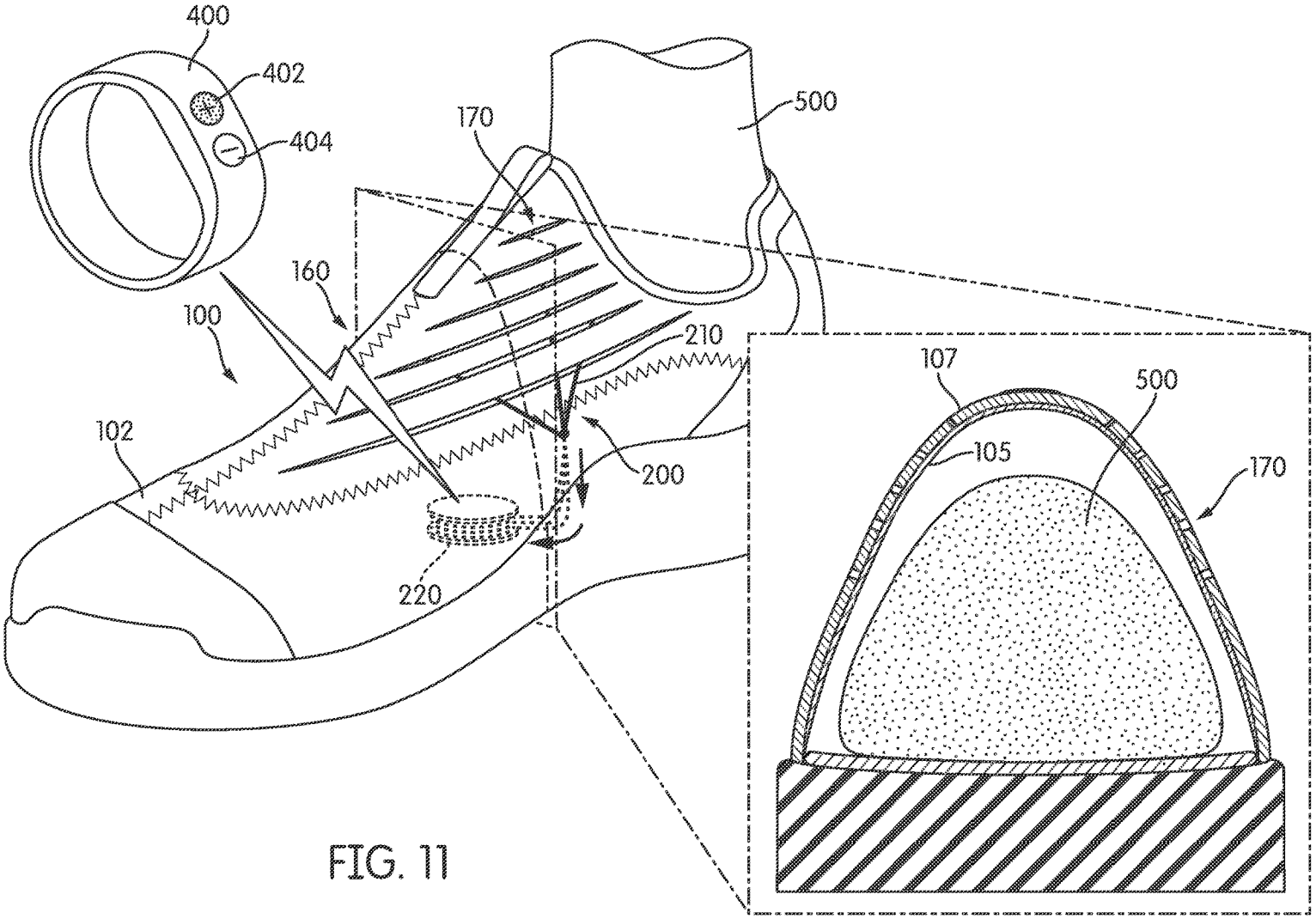
FIG. 11 is a schematic view of an embodiment of an article of footwear with an instep portion starting to contract in volume.
Figure 12:
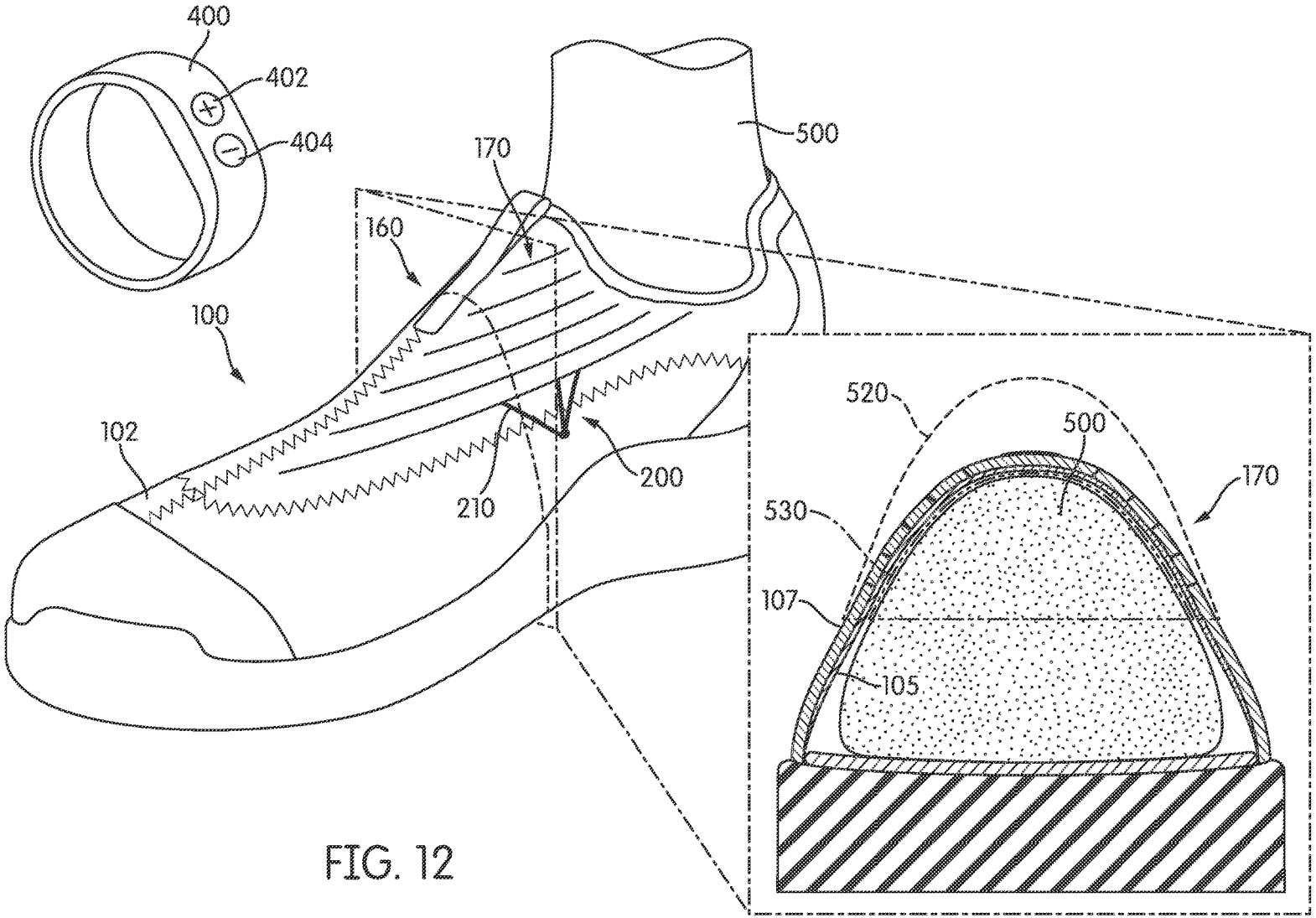
FIG. 12 is a schematic view of an embodiment of an article of footwear with an instep portion in a fully contracted state.

FIGS. 10 through 12 illustrate a sequence of states of article 100 in which tensioning system 200 is used to tighten upper 102. Referring first to FIG. 10, tensioning system 200 is in a fully loosened or minimally tensioned state. In this state, plurality of tensioning members 210 may not substantially restrict the expansion of instep portion 160. Therefore, instep portion 160 is capable of stretching to accommodate foot 500, which has been inserted into upper 102. Specifically, plurality of channels 170 can expand to accommodate an increased volume for instep portion 160. In some cases, this configuration may provide spacing between instep portion 160 and instep 505 of foot 500, as seen in the enlarged cross-section of FIG. 10.

Referring next to FIG. 11, a user may begin to tighten instep portion 160 by pressing tightening button 402. This causes tensioning device 220 to wind plurality of tensioning members 210, thereby applying a generally downward tension to instep portion 160. As plurality of tensioning members 210 pull down in instep portion 160, plurality of channels 170 may decrease in width. This results in a decreased volume for instep portion 160 (and upper 102), as shown in the enlarged cross-section of FIG. 11. In other words, increasing the tension of plurality of tensioning members 210 may act to decrease the volume of instep portion 160.

Generally, tensioning device 220 may continue wind plurality of tensioning members 210 as long as tightening button 402 is pressed (or until a signal that a desired tension level has been achieved). This continued tensioning may act to close plurality of channels 170 until previously separated sections of outer layer 107 come into contact.

A fully tightened state for instep portion 160 (and upper 102 more generally) is shown in FIG. 12. As seen in FIG. 12, the volume of instep portion 160 has been substantially decreased from a first volume 520 (indicated schematically in the cross-section of FIG. 12) to a second volume 530 (indicated schematically in the cross-section of FIG. 12). In particular, first volume 520 represents the approximate volume of instep portion 160 in the fully un-tensioned state seen in FIG. 10, while second volume 530 represents the volume of instep portion 160 in a fully tightened state. It should be clear that while the sections indicated schematically as first volume 520 and second volume 530 are shown as two dimensional sections, these are intended to be indicative of three dimensional volumes bounded from above by instep portion 160.

Although not shown in the figures, a similar process for releasing tension in plurality of tensioning members 210 may occur when a user depresses loosening button 404. This acts to unwind plurality of tensioning members 210 from tensioning device 220, which allows instep portion 160 to increase in volume when forces are applied by the foot to instep portion 160 (or directly by a user grabbing tab portion 175). The degree to which tensioning device 220 is loosened will affect the degree to which instep portion 160 can expand (and therefore the degree to which opening 140 may likewise expand).

In different embodiments, the mechanism that allows the volume of an instep portion to be changed may vary. The embodiments shown in FIGS. 1-12 utilize an instep portion with channels that can increase and decrease in size. However, other embodiments could make use of other provisions that facilitate expansion or contraction of the volume of an instep portion.

Figure 13:
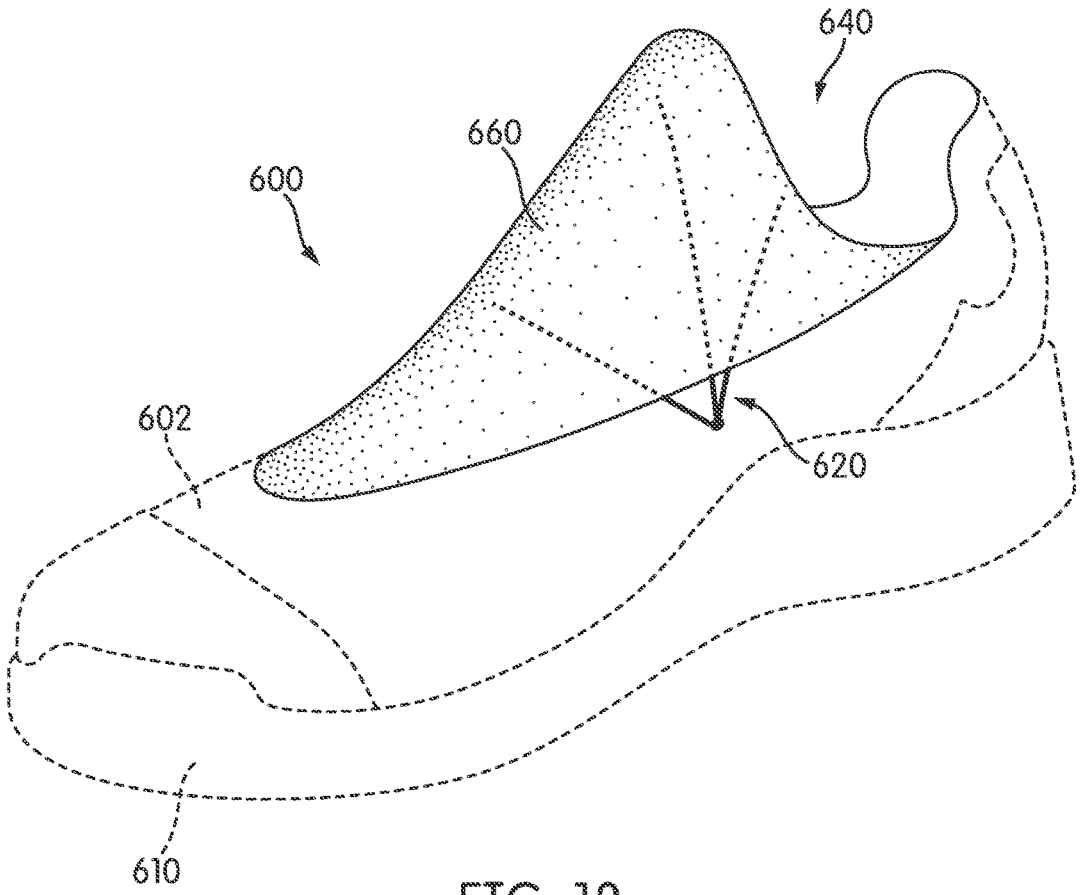
FIG. 13 is a schematic isometric view of an embodiment of an article of footwear with an instep portion in an expanded state.
Figure 14:
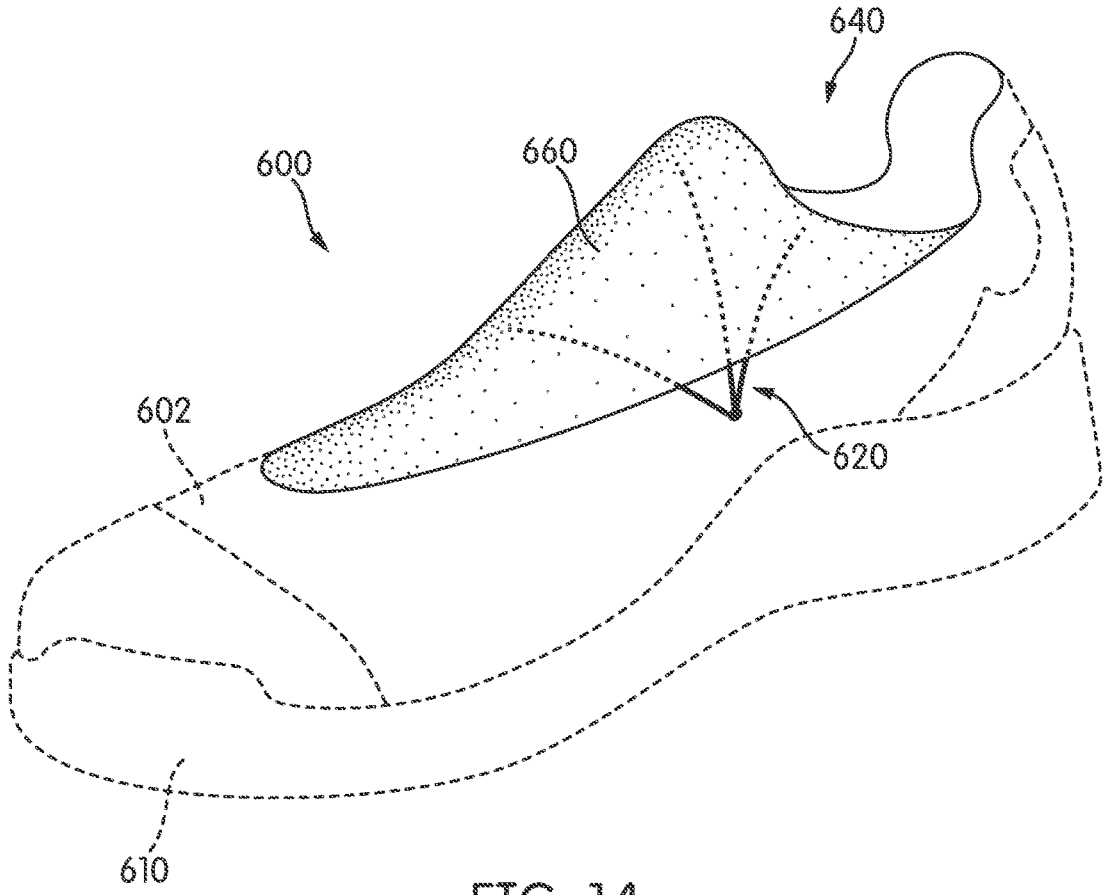
FIG. 14 is a schematic isometric view of an embodiment of an article of footwear with an instep portion in a contracted state.

FIGS. 13 and 14 illustrate a schematic embodiment of an article 600, which includes an upper 602 and a sole structure 610. Article 600 may further include an instep portion 660 having an adjustable volume and an opening 640 that varies in size with instep portion 660. In this embodiment, the structure of instep portion 660 is shown schematically, without depicting a particular mechanism by which instep portion 660 can expand or contract. Generally, such provisions could include channels, slots, pleats, elastic materials, as well as any other mechanical and/or material provisions that would facilitate substantial changes in volume of instep portion 660.

Additionally, in this embodiment, a tensioning system 620 may be used to apply tension to instep portion 660. By increasing the tension applied to instep portion 660, the volume of instep portion 660 can be contracted, as seen when comparing the shape of instep portion 660 in FIG. 13 with the shape of instep portion 660 in FIG. 14.

Figure 15:
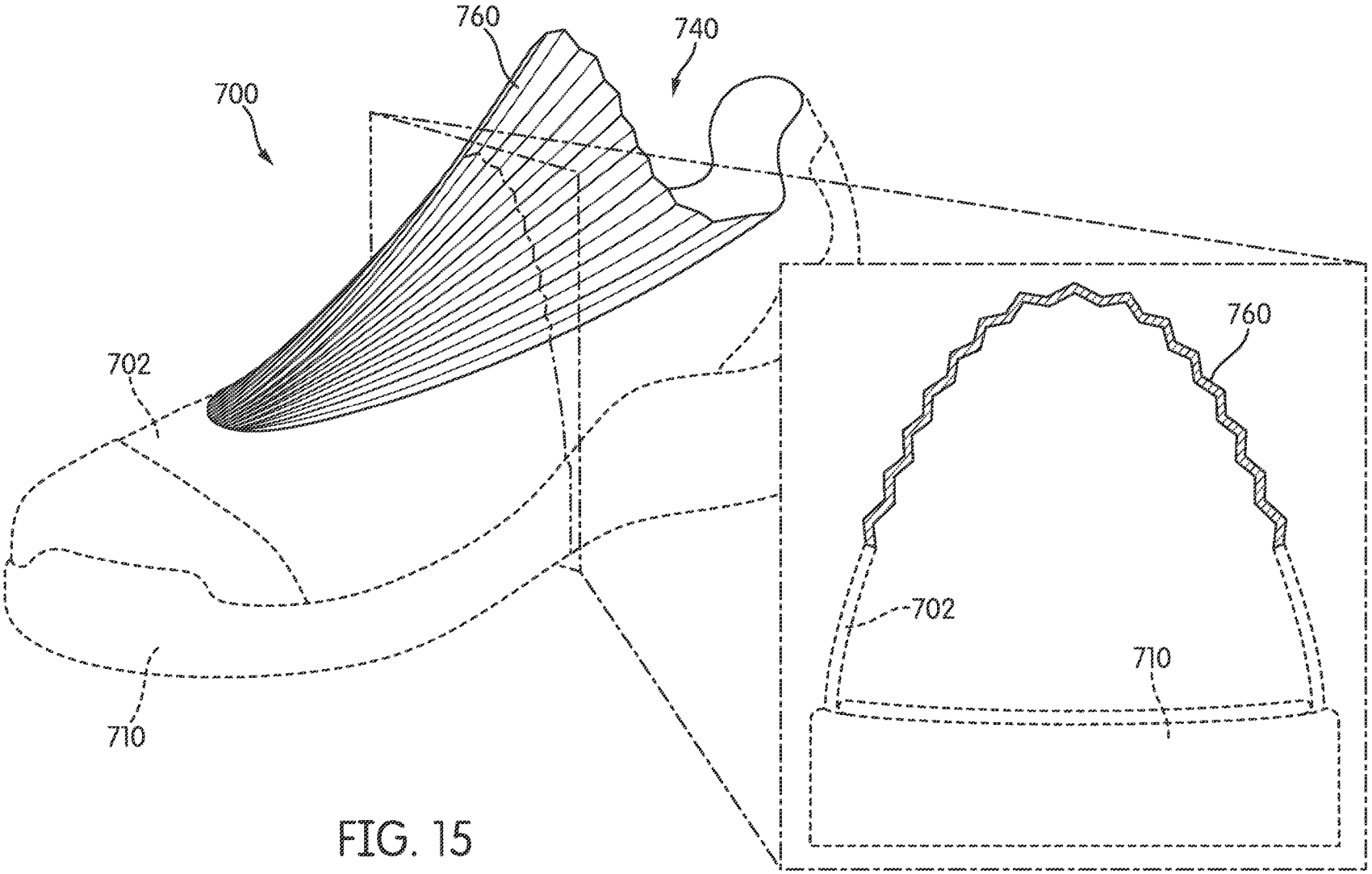
FIG. 15 is a schematic isometric view of another embodiment of an article of footwear with an instep portion in an expanded state.
Figure 16:
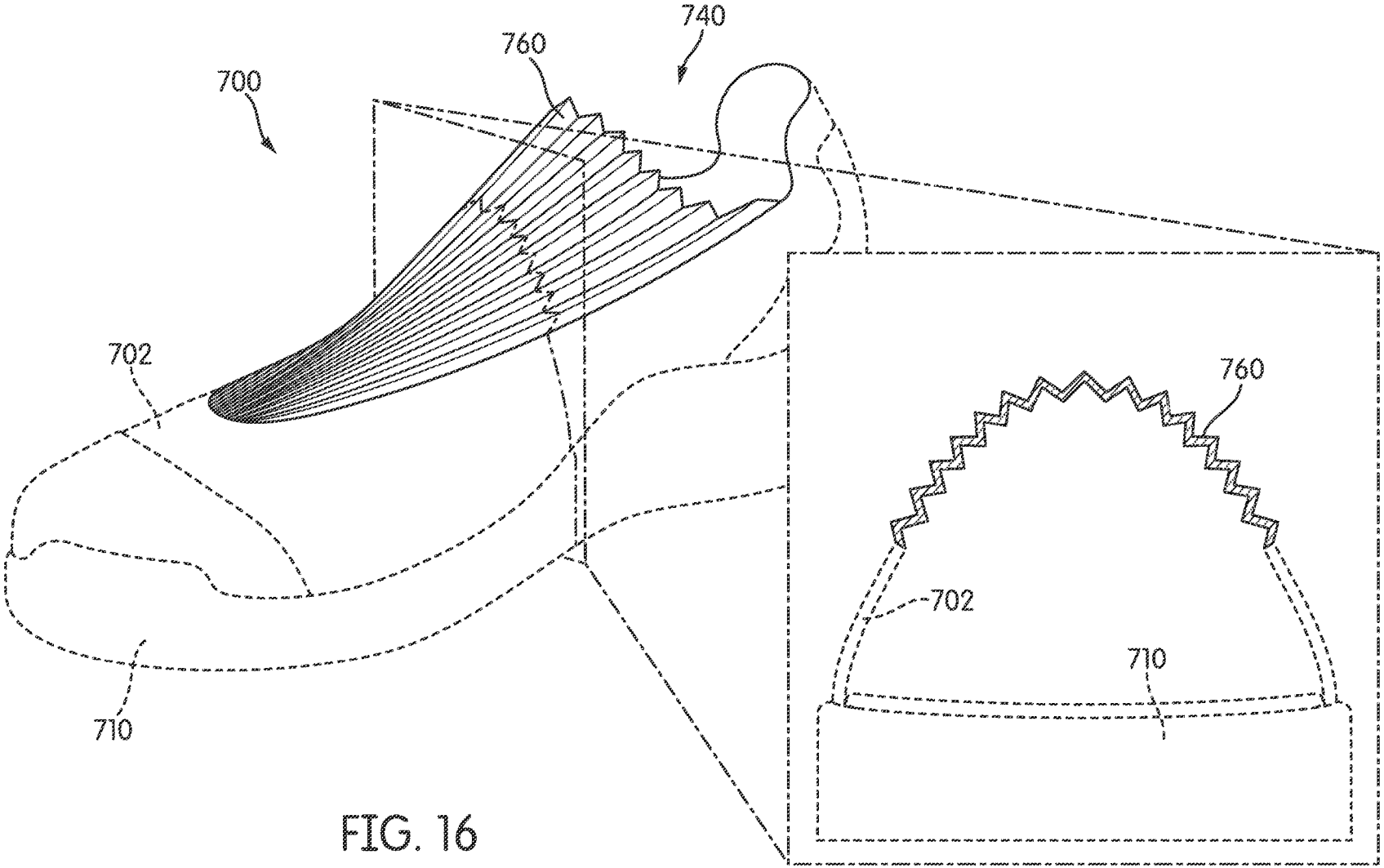
FIG. 16 is a schematic isometric view of another embodiment of an article of footwear with an instep portion in a contracted state.

FIGS. 15 and 16 illustrate still another embodiment of an instep portion with a variable volume. Referring to FIGS. 15 and 16, an article 700 may include an upper 702 and sole structure 710. Upper 702 can include an opening 740 as well as an instep portion 760. In this embodiment, instep portion 760 has a fan-fold geometry. Thus, applying tension across instep portion 760 using a tensioning system (not shown) allows the volume of instep portion 760 to be decreased. Other embodiments could incorporate a section of material having pleats to facilitate expansion and contraction in a similar manner.

Figure 17:
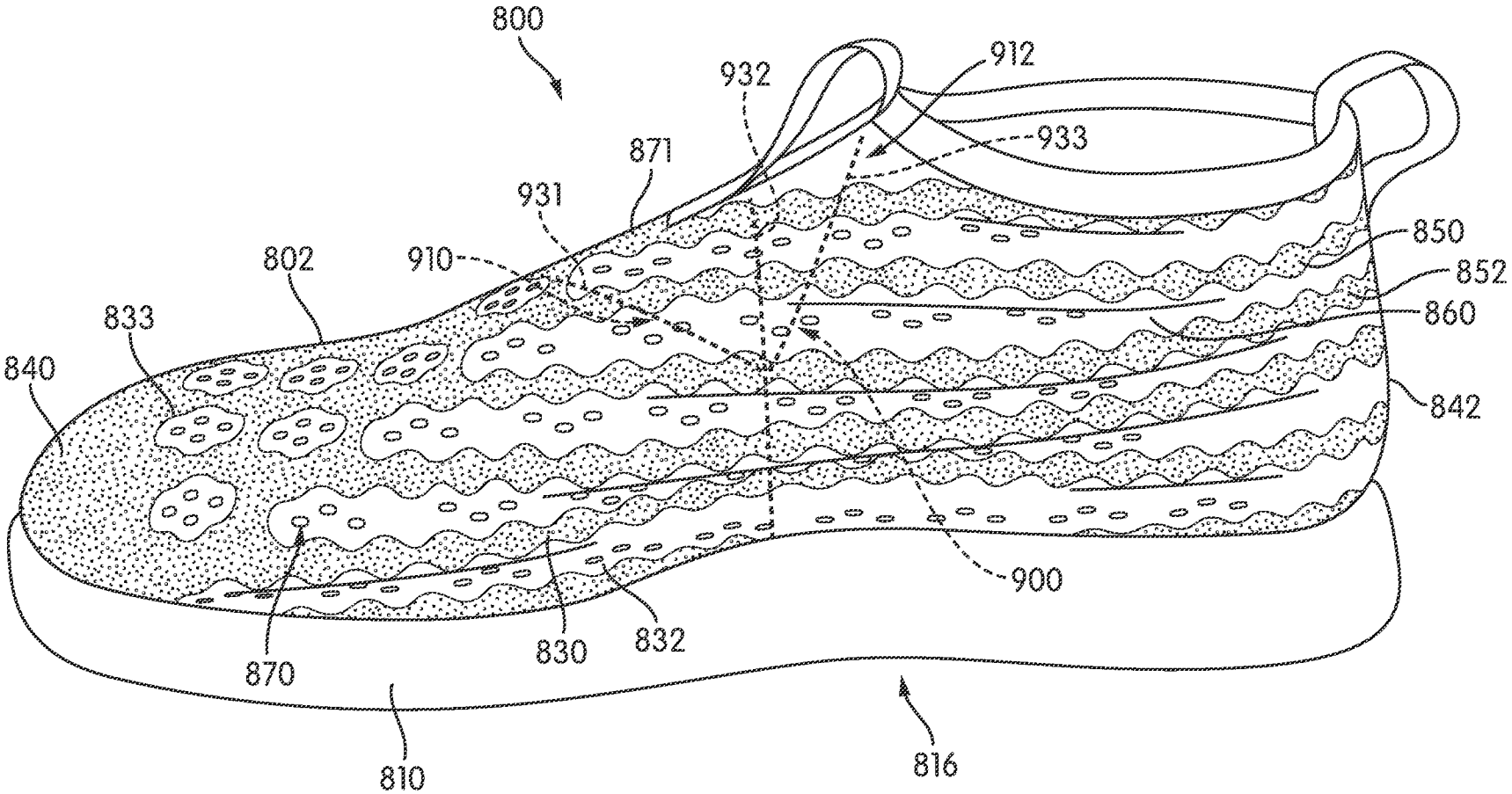
FIG. 17 is a schematic lateral isometric view of another embodiment of an article of footwear.
Figure 18:
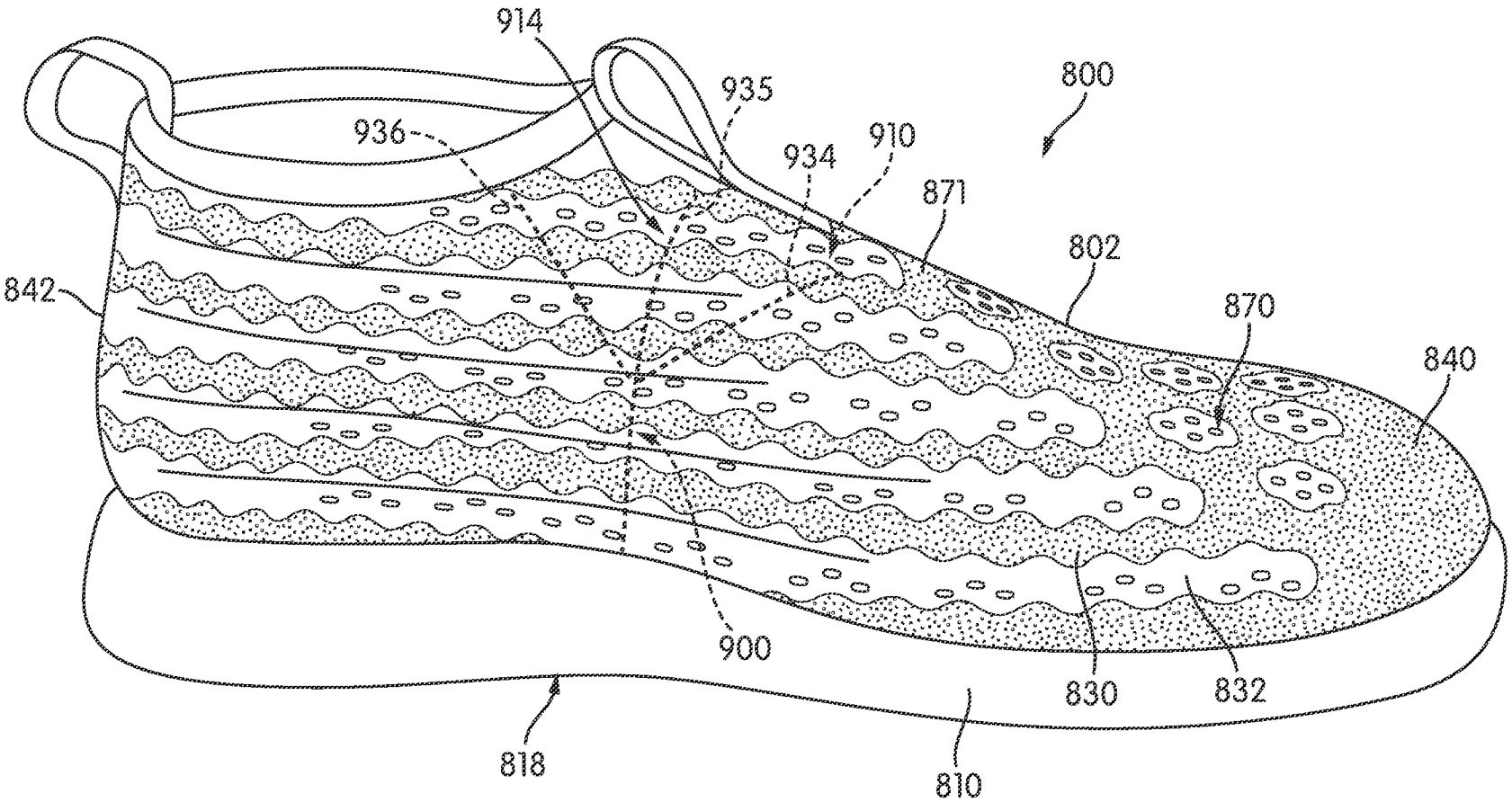
FIG. 18 is a schematic medial isometric view of another embodiment of an article of footwear.

FIGS. 17 and 18 illustrate schematic isometric views of an embodiment of an article of footwear 800 that includes a tensioning system. Article of footwear 800 may include sole structure 810 and upper 802. As with a previous embodiment, article 800 may generally be closed along the top of upper 802, including along instep portion 871. In other words, instep portion 871 may be configured as a closed portion. In particular, instep portion 871 may be closed around the instep of a foot, when a foot has been inserted into article 800.

In some embodiments, a tensioning system 900 may be provided. For purposes of illustration, only some components of tensioning system 900 are shown in the current embodiment. Moreover, in contrast to some previous embodiments, in the embodiment of FIGS. 17-18, the components of tensioning system 900 are not visible on an outer surface of upper 802. In some cases, tensioning system 900 may be similar to the tensioning systems of the earlier embodiments. In particular, tensioning system 900 may include plurality of tensioning members 910.

Plurality of tensioning members 910 may be further grouped into a first group of tensioning members 912 and a second group of tensioning members 914, which are associated with lateral side 816 and medial side 818, respectively, of upper 802. Generally, each group could have any number of tensioning members. In some embodiments, first group of tensioning members 912 and second group of tensioning members 914 may each comprise three distinct tensioning members. However, other embodiments could include any other number of tensioning members in each group of tensioning members, including one, two, three, four or more than four tensioning members. In particular, as seen in FIG. 17, first group of tensioning members 912 may include first tensioning member 931, second tensioning member 932 and third tensioning member 933. Likewise, as seen in FIG. 18, second group of tensioning members 914 may include fourth tensioning member 934, fifth tensioning member 935 and sixth tensioning member 936.

As in the earlier embodiments, the tensioning members in each group may be spread apart over instep portion 871, and may be adjacent one another along the sides of upper 802. Additionally, each tensioning member extends down to a tensioning device (not shown), which applies tension to each tensioning member.

In some embodiments, upper 802 may be configured with provisions to contract in volume under tension, especially in instep portion 871 and adjacent portions. In some embodiments, upper 802 is configured with first set of portions 830 having a first material construction and a second set of portions 832 having a second material construction that is different from the first material construction. For purposes of illustration, an exemplary configuration of first set of portions 830 is shown in FIGS. 17-20 with shading, while an exemplary configuration of second set of portions 832 is shown in FIGS. 17-20 without shading.

In some embodiments, the first set of portions 830 extends through much of toe portion 840. Additionally, first set of portions 830 extend in lengthwise segments from toe portion 840 to heel portion 842. Second set of portions 832 may comprise small disjoint segments 833 within toe portion 840. Additionally, second set of portions 832 includes lengthwise segments that separate adjacent lengthwise portions from first set of portions 830. As an example, as seen in FIG. 17, a first segment 850 and a second segment 852 of first set of portions 830 are separated by a segment 860 of second set of portions 832.

In some embodiments, the first material construction (associated with first set of portions 830) and the second material construction (associated with second set of portions 832) may be substantially different. For example, in some embodiments, the second material construction may be substantially more elastic than the first material construction. In addition, in some embodiments, second set of portions 832 may be associated with plurality of holes 870, which can facilitate breathability for upper 802 and also increase flexibility for second set of portions 832. This configuration for the first material construction and the second material construction may facilitate the contraction of second set of portions 832 as upper 802 is tensioned.

Figure 19:
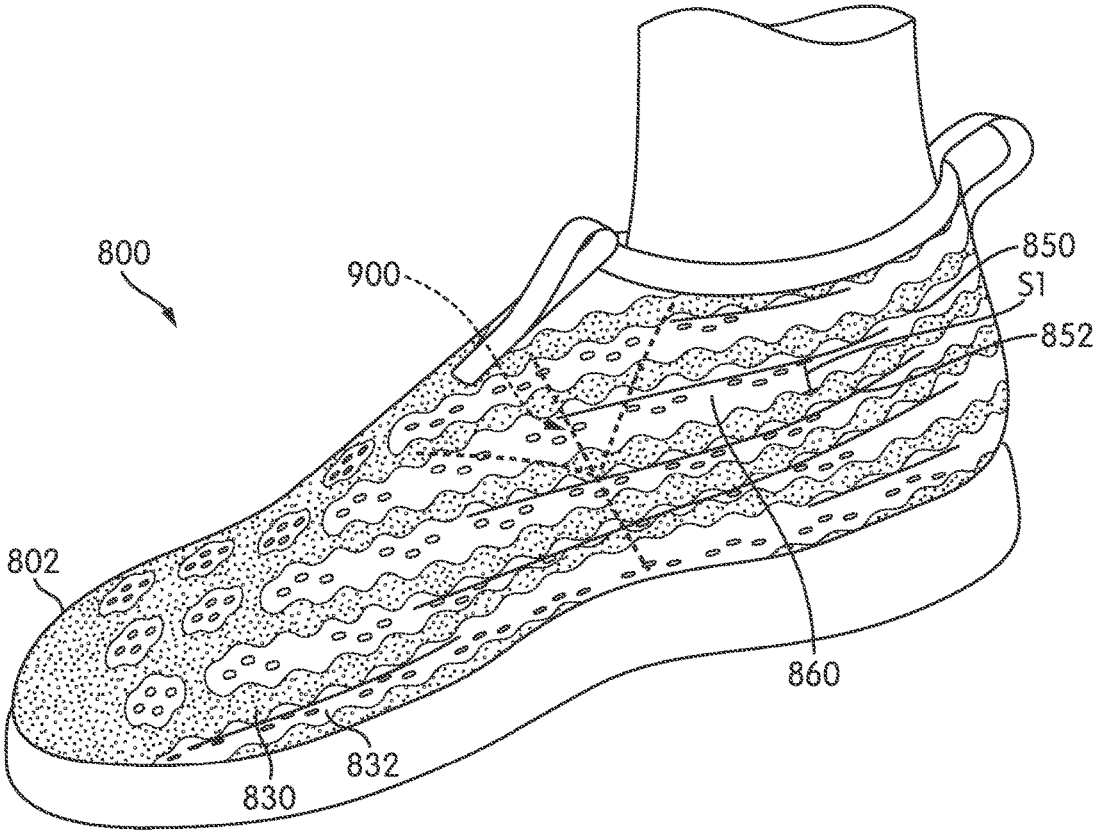
FIG. 19 is a schematic isometric view of the article of footwear of FIG. 17 in an un-tensioned state.
Figure 20:
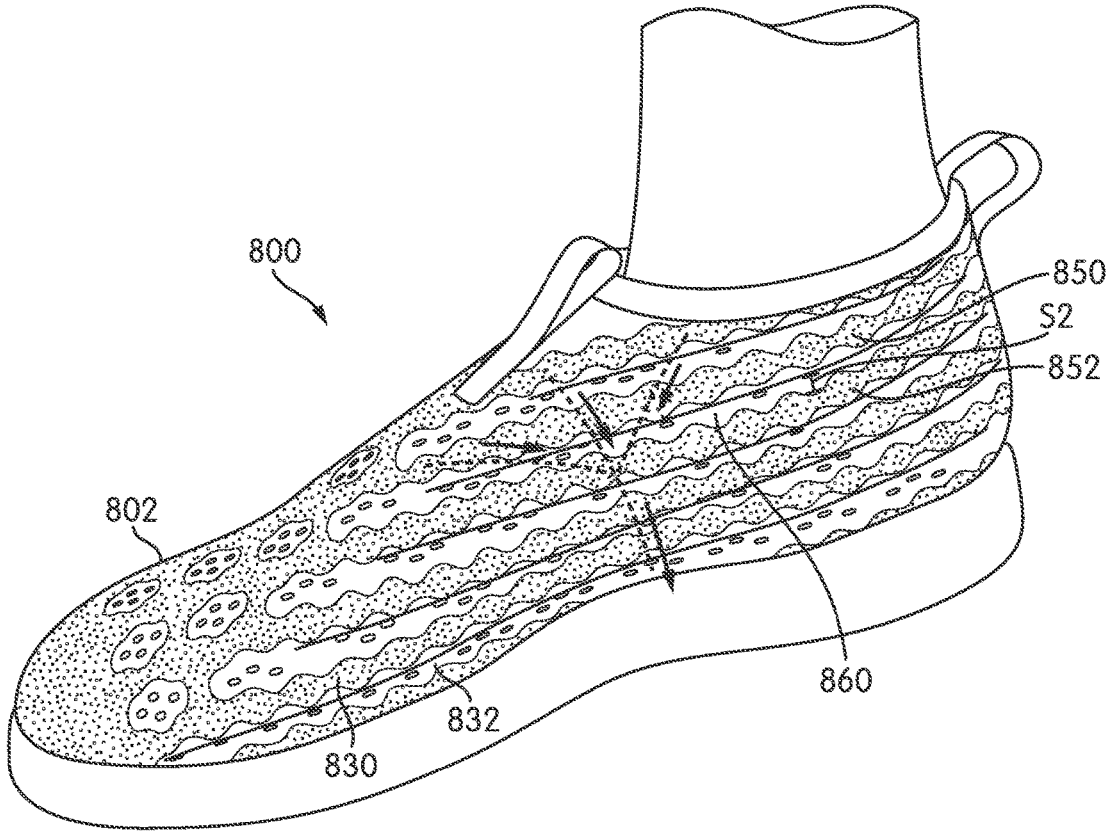
FIG. 20 is a schematic isometric view of the article of footwear of FIG. 17 in a tensioned state.

FIGS. 19 and 20 illustrate schematic isometric views of article 800 in an un-tensioned state and a tensioned state, respectively. As seen in FIG. 19, prior to tensioning upper 802 using tensioning system 900, the alternating lengthwise segments of second set of portions 832 are expanded in the widthwise direction of each segment. However, as tension is applied via tensioning system 900, the lengthwise segments of second set of portions 832 begin to contract in the widthwise direction. Thus, as seen in comparing FIGS. 19 and 20, the relative spacing between adjacent lengthwise segments of first set of portions 830 decreases. For example, segment 850 and segment 852, may be initially separated by an average spacing 51 as shown in FIG. 19. However, as segment 860 contracts, segment 850 and segment 852 are separated by an average spacing S2 that is substantially less than average spacing 51. As the spacing between adjacent segments of first set of portions 830 is decreased, the overall volume enclosed within upper 802 is decreased. This results in a tightened fit for upper 802 around a wearer's foot.

In different embodiments, the geometry of different portions of article 800 could vary. In an exemplary embodiment, lengthwise segments of first set of portions 830 and second set of portions 832 may generally have curved or non-linear edges. In some cases, the lengthwise segments of first set of portions 830 and second set of portions 832 have corresponding wavy edges, including alternating crests and troughs. In some embodiments, segments of first set of portions 830 that are separated by a corresponding segment from second set of portions 832 could be configured so that the crests of each segment are approximately aligned in a longitudinal direction. In such an embodiment, the crests of the segments of first set of portions 830 could come into contact with one another as second set of portions 832 contract under tension. In other embodiments, segments of first set of portions 830 that are separated by a corresponding segment from second set of portions 832 could be configured so that a crest of one segment is aligned with a trough of another segment in the longitudinal direction. In such an embodiment, the crests of one segment may fit into the troughs of another segment as second set of portions 832 contract under tension. By varying the alignment of adjacent segments from first set of portions 830, the overall fit of article 800 during a contracted or tensioned state can be tuned.

Figure 21:
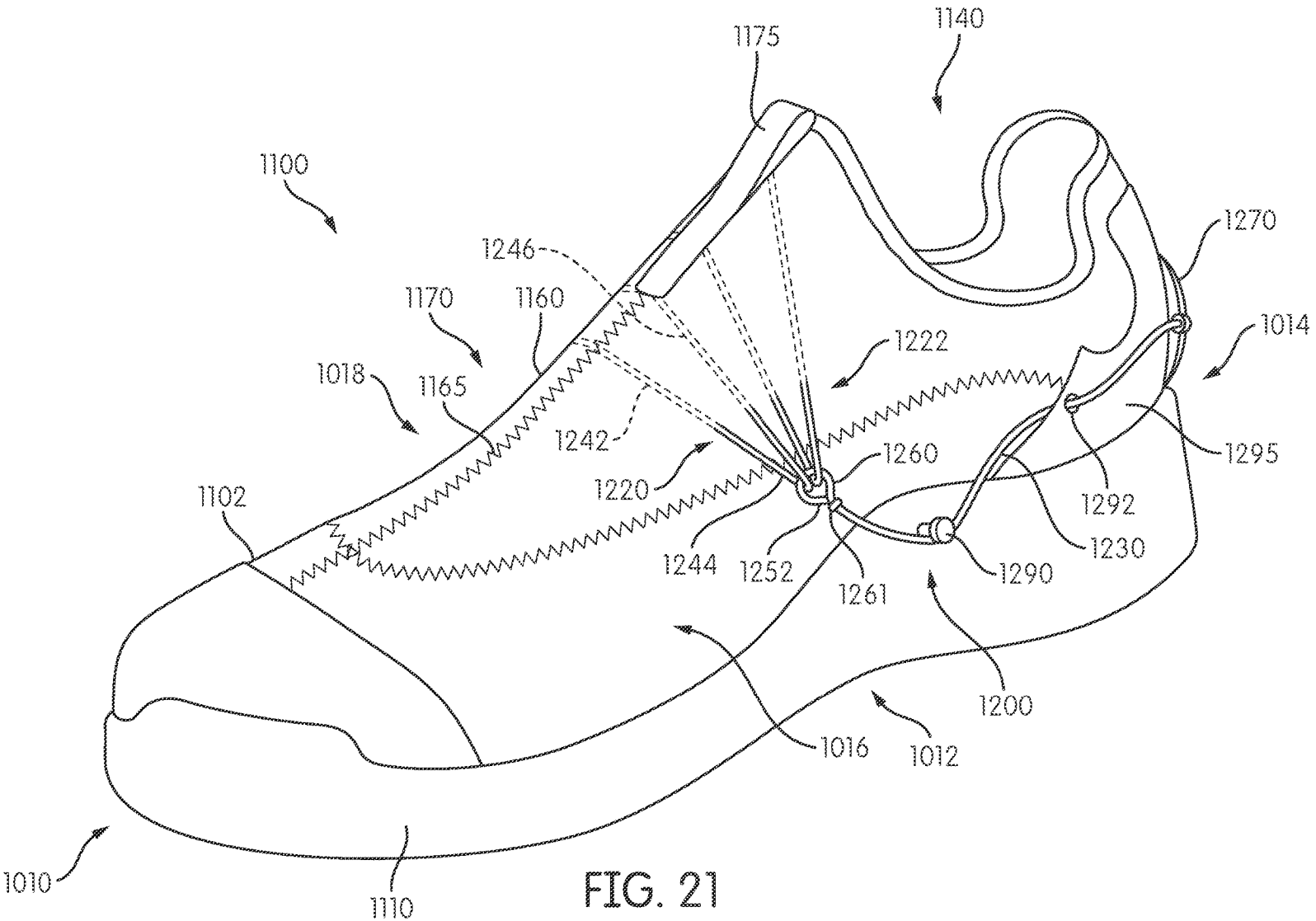
FIG. 21 is a schematic isometric view of an embodiment of an article of footwear with a tensioning system.
Figure 22:
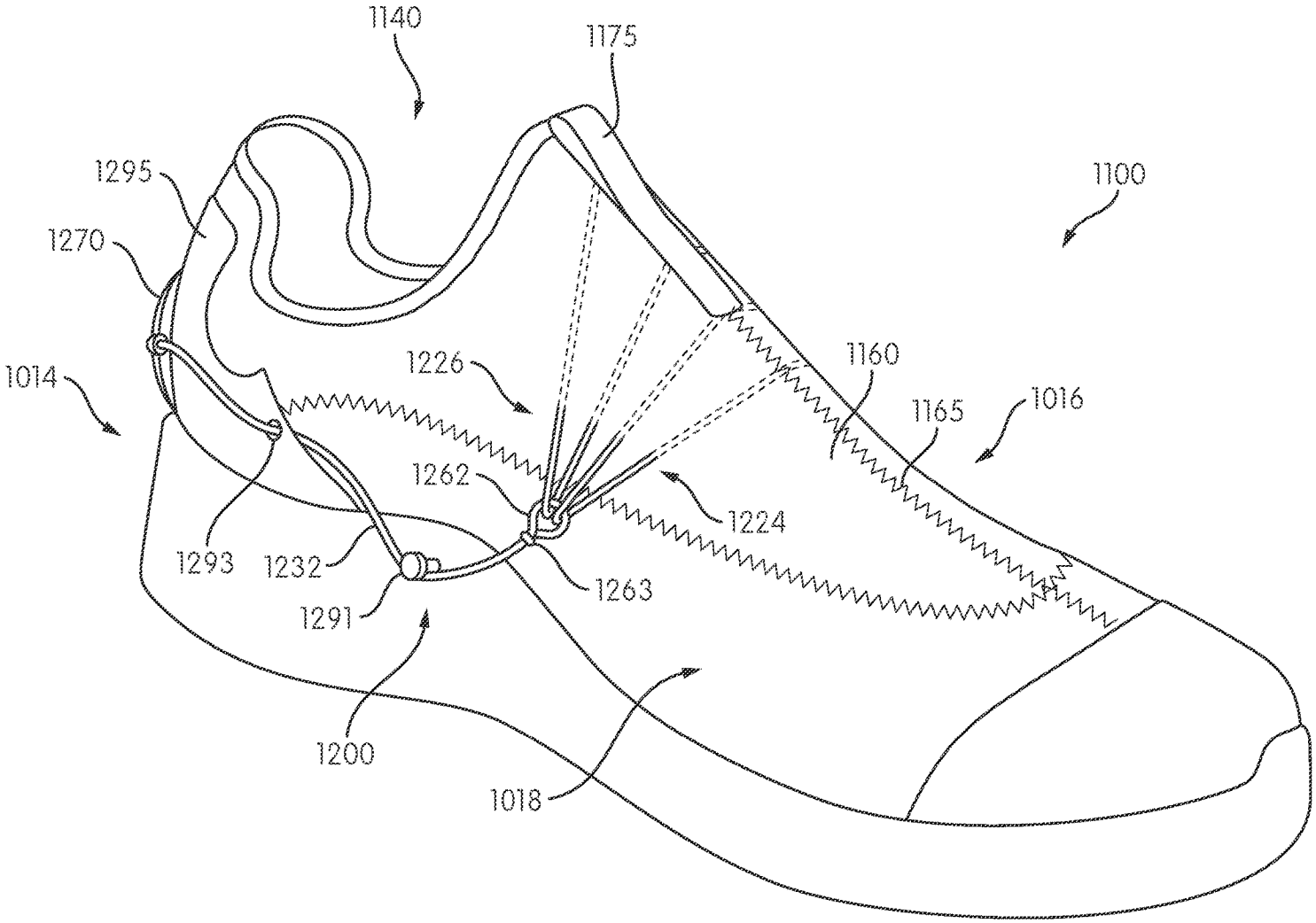
FIG. 22 is a schematic isometric view of an embodiment of an article of footwear with a tensioning system.

FIGS. 21 and 22 illustrate schematic isometric views of an embodiment of an article of footwear 1100, also referred to simply as article 1100. Article 1100 may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 1100 may be configured as various kinds of non-sports related footwear, including, but not limited to: slippers, sandals, high heeled footwear, loafers as well as any other kinds of footwear, apparel and/or sporting equipment (e.g., gloves, helmets, etc.).

It will be understood that article of footwear 1100 may be configured with any of the provisions, features, systems and/or components which have already been described in previous embodiments and shown in FIGS. 1-20. For purposes of clarity, some of these features may be discussed with respect to the embodiment shown in FIGS. 21-30, but not all features may be discussed. However, any of the features discussed in each embodiment of the disclosure could be optionally part of any other embodiment, such that features of different embodiments can be combined in any manner.

Referring to FIG. 21, for purposes of reference, article 1100 may be divided into forefoot portion 1010, midfoot portion 1012 and heel portion 1014. Forefoot portion 1010 may be generally associated with the toes and joints connecting the metatarsals with the phalanges. Midfoot portion 1012 may be generally associated with the arch of a foot. Likewise, heel portion 1014 may be generally associated with the heel of a foot, including the calcaneus bone. In addition, article 1100 may include lateral side 1016 and medial side 1018. In particular, lateral side 1016 and medial side 1018 may be opposing sides of article 1100. Furthermore, both lateral side 1016 and medial side 1018 may extend through forefoot portion 1010, midfoot portion 1012 and heel portion 1014.

Article 1100 may include an upper 1102 as well as a sole structure 1110. In some embodiments, sole structure 1110 may be configured to provide traction for article 1100. In addition to providing traction, sole structure 1110 may attenuate ground reaction forces when compressed between the foot and the ground during walking, running or other ambulatory activities. The configuration of sole structure 1110 may vary significantly in different embodiments to include a variety of conventional or non-conventional structures. In some cases, the configuration of sole structure 1110 can be configured according to one or more types of ground surfaces on which sole structure 1110 may be used. Examples of ground surfaces include, but are not limited to: natural turf, synthetic turf, dirt, as well as other surfaces.

Generally, upper 1102 may be any type of upper. In particular, upper 1102 may have any design, shape, size and/or color. For example, in embodiments where article 1100 is a basketball shoe, upper 1102 could be a high top upper that is shaped to provide high support on an ankle. In embodiments where article 1100 is a running shoe, upper 1102 could be a low top upper.

In some embodiments, upper 1102 includes opening 1140 that provides entry for the foot into an interior cavity of upper 1102. Opening 1140 may be bounded from a rearward direction by heel portion 1014 of upper 1102. In some embodiments, upper 1102 further includes an instep portion 1160 that corresponds to the top of a foot.

In contrast to some other upper configurations, article 1100 may generally be closed along the top of upper 1102, including along instep portion 1160. In other words, instep portion 1160 may be configured as a closed portion. In particular, instep portion 1160 may be closed around the instep of a foot, when a foot has been inserted into article 1100.

Upper 1102 may further be associated with an intermediate covering portion 1170. In a similar manner to the embodiment described above and shown in FIG. 5, intermediate covering portion 1170 may be associated with a corresponding interior volume. As portions of article 1100 are expanded and contracted in response to changes in tension of various tensioning members, the interior volume of intermediate covering portion 1170 may generally change accordingly. Thus, for example, as portions of article 1100 contract with increased tension, the interior volume of intermediate covering portion 1170 may decrease. Likewise, as portions of article 1100 expand with decreased tension, the interior volume of intermediate covering portion 1170 may increase.

In order to facilitate entry of a foot into upper 1102, intermediate covering portion 1170 may include provisions for expanding and contracting, especially at instep portion 1160, which may be part of intermediate covering portion 1170.

For purposes of clarity, article 1100 is illustrated schematically without details regarding provisions for expanding and/or contracting at instep portion 1160. However, it will be understood that other embodiments may utilize a variety of different provisions to facilitate the expansion and contraction of portions of an upper. Some embodiments may use a material having slots or other narrow openings, such as those that have been described above and depicted in FIGS. 10-12, for example. Other embodiments could use materials constructed with a fan-fold geometry, as described above and shown in FIGS. 15-16. Still other embodiments could use material constructions as shown in FIGS. 17-20, in which strips of alternating materials having different characteristics are used to facilitate expansion and contraction of an upper. Moreover, other embodiments could use any other means that allows instep portion 1160 (as well as possibly other portions of upper 1102) to expand and contract, thereby changing the volume of intermediate covering portion 1170.

Figure 23:
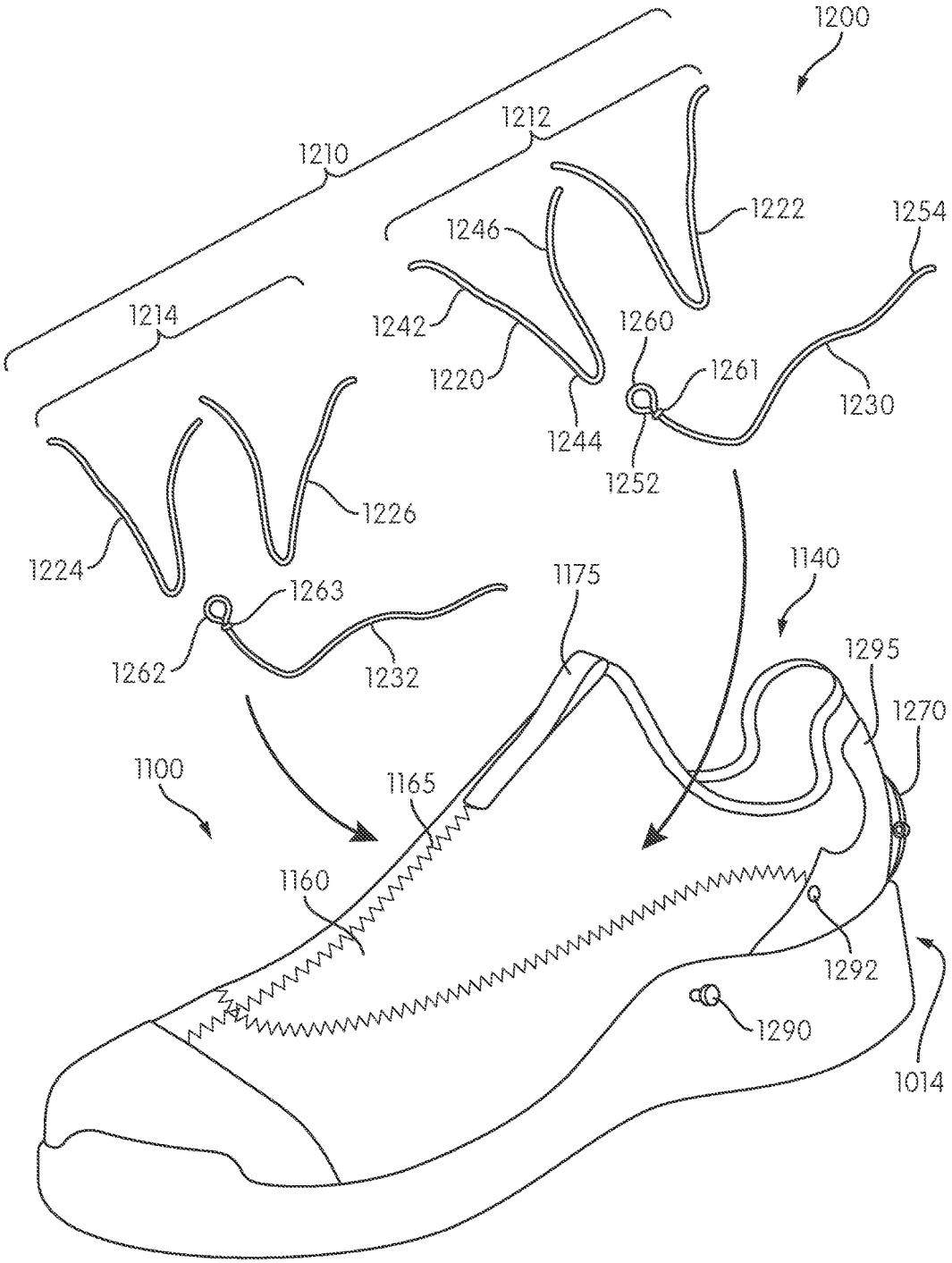
FIG. 23 is a schematic exploded isometric view of the article of footwear of FIG. 21.

FIG. 23 illustrates an exploded isometric view of article 1100, including components of a tensioning system discussed below. Referring now to FIGS. 21-23, some embodiments may include tab portion 1175. In some embodiments, tab portion 1175 is a tab-like portion disposed along the top of instep portion 1160. In some embodiments, tab portion 1175 has a looped geometry that can be easily grasped with a finger. In some cases, tab portion 1175 may be disposed adjacent to opening 1140. Tab portion 1175 may be grasped and pulled by a user to expand instep portion 1160. This allows opening 1140 to increase in size temporarily, thereby permitting entry of a foot through opening 1140. With tab portion 1175 released, instep portion 1160 may return to a pre-tensioned size and/or volume.

Embodiments can include provisions to facilitate contracting intermediate covering portion 1170 (and thereby reducing its volume) once a foot has been inserted in order to tighten the fit of upper 1102 to the foot. In some embodiments, article 1100 may include tensioning system 1200 that may provide tension across instep portion 1160.

Tensioning system 1200 may further comprise one or more tensioning members as well as a tensioning device. Examples of possible tensioning members that could be used include, but are not limited to: cables, wires, strings, laces, straps as well as any other kinds of tensioning members. Moreover, exemplary tensioning devices include, but are not limited to: winding devices (e.g., reels and spools), springs, as well as any other devices, systems or components that can be used to apply tension to any portion of a tensioning member.

In some embodiments, tensioning system 1200 may include plurality of tensioning members 1210 (see FIG. 23). Plurality of tensioning members 1210 may comprise cable-like or wire-like members. In particular, the tensioning members of the current embodiment may be characterized as being approximately one-dimensional. In other words, each tensioning member may generally have a length that is substantially greater than the width, thickness and/or diameter of the tensioning member. In other embodiments, however, one or more tensioning members could be approximately two-dimensional members (e.g., ribbons or straps).

Tensioning system 1200 may be configured with tensioning members linked together in a parallel and/or serial manner. In particular, tensioning system 1200 may include some tensioning members that directly engage (i.e., apply tension directly to) portions of upper 1102 and tensioning system 1200 may also include some tensioning members that transfer forces between the directly engaged tensioning members and a power source, such as a tensioning device. For purposes of clarity, tensioning members that directly engage (e.g., pull and/or compress) upper 1102 are referred to as driven tensioning members, while tensioning members that pull on the driven tensioning members are referred to as driving tensioning members. However, it will be understood that these labels are only intended for purpose of clarity and that both driving tensioning members and driven tensioning members could be configured as similar material elements (e.g., wires, cables, ropes, laces, etc.). Thus, in the illustrated embodiments, driving tensioning members may act to transfer tension between a tensioning device and one or more driven tensioning members. In other words, driving tensioning members may pull on driven tensioning members, while the driven tensioning members directly apply tension to (e.g., pull) on portions of upper 1102.

In an exemplary embodiment, each side of upper 1102 is associated with a set of driven tensioning members, as well as a driving tensioning member. For example, referring to FIG. 23, a first set of tensioning members 1212 is associated with lateral side 1016 of upper 1102, while a second set of tensioning members 1214 is associated with medial side 1018 of upper 1102. First set of tensioning members 1212 includes first driven tensioning member 1220 and second driven tensioning member 1222, which are both engaged directly with upper 1102. Likewise, second set of tensioning members 1214 includes third driven tensioning member 1224 and fourth driven tensioning member 1226, which are both engaged directly with upper 1102.

Tensioning system 1200 further includes first driving tensioning member 1230 and second driving tensioning member 1232. First driving tensioning member 1230 may be associated with the tensioning members of first set of tensioning members 1212, in a manner discussed in further detail below. Likewise, second driving tensioning member 1232 may be associated with the tensioning members of second set of tensioning members 1214.

For purposes of clarity, the following discussion is directed to the specific configuration of first driven tensioning member 1220, second driven tensioning member 1222 and first driving tensioning member 1230 on lateral side 1016 of article 1100. However, it will be understood that in some embodiments third driven tensioning member 1224, fourth driven tensioning member 1226 and second driving tensioning member 1232 may be arranged in a substantially similar configuration on medial side 1018. Thus, it will be understood that the principles discussed with respect to first driven tensioning member 1220, second driven tensioning member 1222 and first driving tensioning member 1230 may likewise apply to third driven tensioning member 1224, fourth driven tensioning member 1226 and second engaged driving tensioning member 1232.

Generally, each driven tensioning member has a first portion, a second portion and a third portion. The first portion and the third portion may extend through instep portion 1160 (and intermediate covering portion 1170), while the second portion separates the first portion and the third portion. For example, in certain embodiments depicted in FIGS. 21-23, first driven tensioning member 1220 includes a first portion 1242, a second portion 1244 and a third portion 1246. In this case, first portion 1242 and third portion 1246 extend through some of instep portion 1160 (and intermediate covering portion 1170). Second portion 1244 is disposed between first portion 1242 and third portion 1246. Each of second driven tensioning member 1224, third driven tensioning member 1226 and fourth driven tensioning member 1228 may include similar portions.

Each driving tensioning member generally extends between one or more driven tensioning members and a tensioning device. In the embodiments shown in FIGS. 21-23, first driving tensioning member 1230 has a first end portion 1252 that is associated with first driven tensioning member 1220 and second driven tensioning member 1222. First driving tensioning member 1230 also has a second end portion 1254 that is associated with a tensioning device 1270. In some embodiments, second driving tensioning member 1232 may similarly extend between one or more driven tensioning members and tensioning device 1270.

Tensioning system 1200 further includes tensioning device 1270 that may be used to adjust the tension in plurality of tensioning members 1210. For purposes of clarity, tensioning device 1270 is shown schematically in the current embodiments. However, tensioning device 1270 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Patent Application Publication Number 2010/0139057, now U.S. patent application Ser. No. 12/623,362, filed Nov. 20, 2009 and titled "Reel Based Lacing System", the entirety of which is hereby incorporated by reference. Examples of a motorized tensioning device that could be used with the current embodiments are disclosed in Beers, U.S. Patent Publication Number 2014/0070042, published Mar. 13, 2014, and filed as U.S. patent application Ser. No. 14/014,555, on Aug. 30, 2013, and titled "Motorized Tensioning System with Sensors", the entirety being incorporated by reference herein. In an exemplary embodiment, tensioning device 1270 could be a reel-based tensioning device that winds the tensioning members onto a reel to increase the tension.

In different embodiments, the location of tensioning device 1270 could vary. In some embodiments, tensioning device 1270 could be disposed in a portion of upper 1102. In other embodiments, tensioning device 1270 could be disposed in a portion of sole structure 1110. In an exemplary embodiment, tensioning device 1270 may be mounted to heel portion 1014 of article 1100 at upper 1102. Moreover, in the illustrated embodiments, tensioning device 1270 includes an outer casing that may enclose a winding mechanism (not shown).

Embodiments can include provisions to balance the tension applied to two or more driven tensioning members by a driving tensioning member, such that the loads across instep portion 1160 are more evenly distributed. In some embodiments, a tensioning system may incorporate a tension balancing member. The term "tension balancing member" as used throughout this detailed description refers to any component, device or system that facilitates the balancing of tension between two or more different tensioning members and/or across different portions of a single tensioning member.

In some embodiments, each driving tensioning member is configured with a looped end that provides a tension balancing member for tensioning system 1200. For example, first driving tensioning member 1230 incorporates a first tension balancing member 1260, which is comprised of a looped end of first driving tensioning member 1230 that is fixed in place with fastener 1261. Likewise, second driving tensioning member 1232 has a second tension balancing member 1262, which is comprised of a looped end of second actuating member 1232 that is fixed in place with a fastener 1263.

It will be appreciated that a looped end of an actuating member is only one possible kind of tension balancing member that could be used. Still further embodiments could incorporate other kinds of tension balancing members that may act to distribute loads between two or more driven tensioning members in order to better balance forces applied over different regions of an upper. It may therefore be appreciated by those skilled in the art that any kinds of force transfer and/or force balancing devices could be utilized at the interface between a driving tensioning member and two or more driven tensioning members.

In some embodiments, article 1100 may be configured with provisions to facilitate the attachment and/or control of tensioning members in an article. In some embodiments, article 1100 may include a fixed guide member 1290, which may act to help guide the path of first driving tensioning member 1230. In some embodiments, fixed guide member 1290 may be mounted to, and extend outwardly from, sole structure 1110. A similar fixed guide member 1291 may be used to help guide the path of second driving tensioning member 1232. In some cases, fixed guide member 1290 and fixed guide member 1291 may be positioned to control the direction of pulling applied by first driving tensioning member 1230 and second driving tensioning member 1232, respectively, to plurality of driven tensioning members 1210. Specifically, in some cases, this arrangement ensures that plurality of driven tensioning members 1210 may be pulled in a generally downwards direction (i.e., a direction towards sole structure 1110). This arrangement may help maintain balanced tension throughout different driven tensioning members.

Some embodiments may include an aperture 1292 to receive first driving tensioning member 1230 and an aperture 1293 to receive second driving tensioning member 1232, respectively. In some embodiments aperture 1292 and aperture 1293 may be formed in an external heel counter 1295. In still other cases, apertures could be formed directly in upper 1102. Moreover, it will be understood that in other embodiments any other guides, channels, apertures or other provisions for guiding the path of driving tensioning members could be used.

As seen in FIGS. 21-22, the various tensioning members may be arranged on article 1100 to provide a means for closing instep portion 1160 around a foot. To achieve this, first set of driven tensioning members 1212 and second set of driven tensioning members 1214 are mounted to instep portion 1160. In some embodiments, the ends of each driven tensioning member may be attached to a top portion 1165 of instep portion 1160. For example, in some embodiments, first portion 1242 and third portion 1246 of first driven tensioning member 1220 may include ends that are fixedly attached to top portion 1165. Similarly, in some cases, the remaining driven tensioning members may include ends attached along top portion 1165. However, in other embodiments, the ends of tensioning members could be mounted to any other portion of instep portion 1160 and/or of article 1100. Moreover, as discussed below, in other embodiments, driven tensioning members could extend over instep portion 1160 and may extend between tensioning balancing members on opposing sides of article 1100.

Each driven tensioning member is looped through a tension balancing member. For example, first driven tensioning member 1220 and second driven tensioning member 1222 are disposed through first tension balancing member 1260. Likewise, third driven tensioning member 1224 and fourth driven tensioning member 1226 are disposed through second tension balancing member 1262.

From first tension balancing member 1260, first driving tensioning member 1230 extends around fixed guide member 1290, and then through aperture 1292. Thus, first driving tensioning member 1230 extends from instep portion 1160 towards sole structure 1110, then back towards heel portion 1014. Finally, second end portion 1254 of first driving tensioning member 1230 is fed into tensioning device 1270 where it may be wound on a reel or other tensioning mechanism.

From second tension balancing member 1262, second driving tensioning member 1232 extends around fixed guide member 1291, and then through aperture 1293. Thus, second driving tensioning member 1232 extends from instep portion 1160 towards sole structure 1110, then back towards heel portion 1014. Finally, an end portion of second driving tensioning member 1232 is fed into tensioning device 1270 where it may be wound on a reel or other tensioning mechanism.

Figure 24:
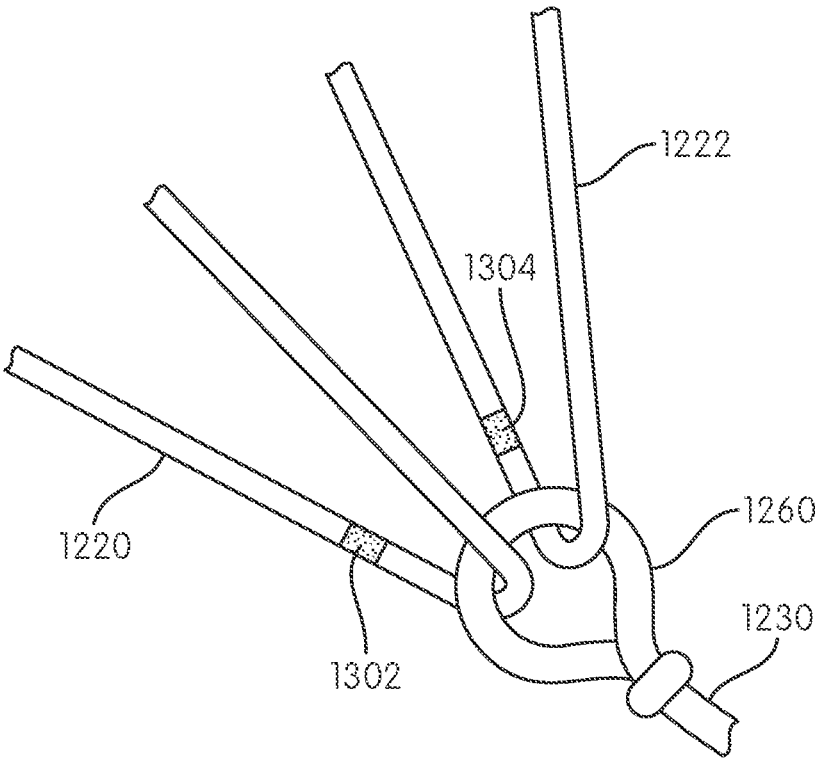
FIG. 24 is a schematic view of an embodiment of some tensioning members of the tensioning system of FIG. 21.
Figure 25:
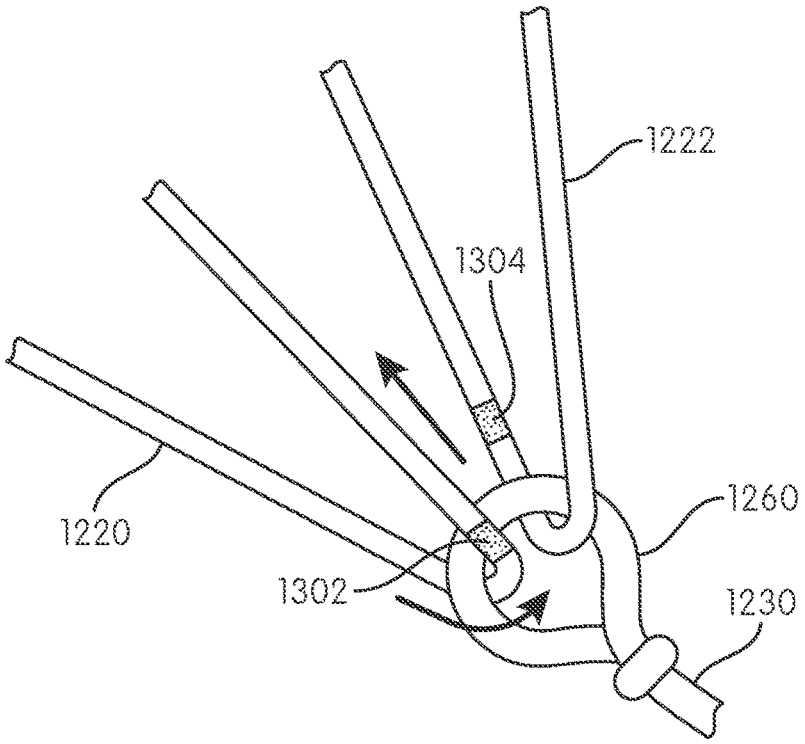
FIG. 25 is a schematic view of the tensioning members of FIG. 24, in which a first tensioning member has moved through a tension balancing member.
Figure 26:
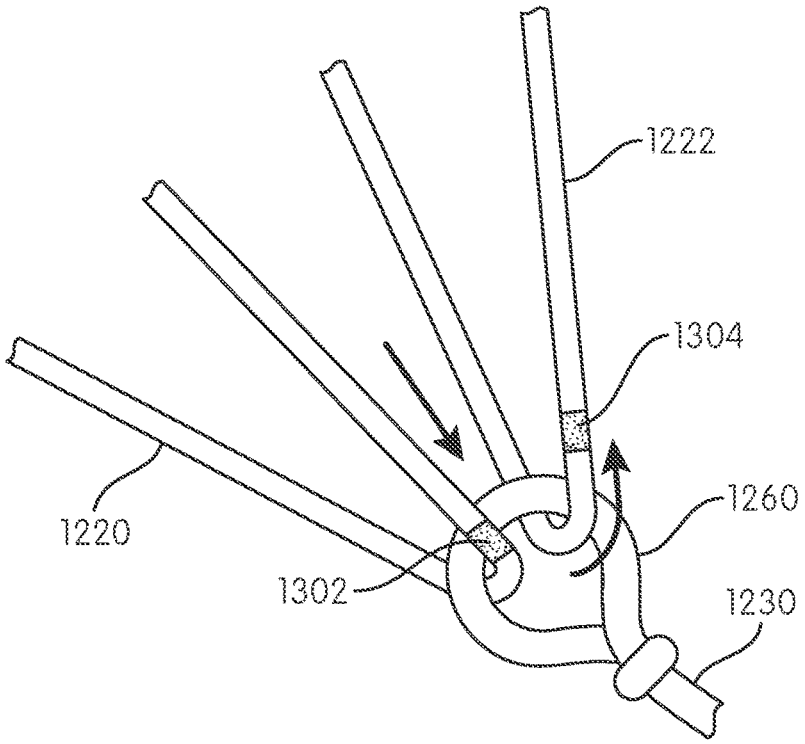
FIG. 26 is a schematic view of the tensioning members of FIG. 24, in which a second tensioning member has moved through a tension balancing member.

FIGS. 24-26 illustrate enlarged isometric views of portions of tensioning system 1200, including portions of first driving tensioning member 1230, first driven tensioning member 1220 and second driven tensioning member 1222. As seen in FIGS. 24-26, portions of first driven tensioning member 1220 and second driven tensioning member 1222 are disposed through first tension balancing member 1260.

As indicated schematically in FIGS. 25-26, first driven tensioning member 1220 and second driven tensioning member 1222 are free to move through first tension balancing member 1260. For purposes of illustration, a portion 1302 of first driven tensioning member 1220 is shaded, while a portion 1304 of second driven tensioning member 1222 is shaded, in order to better illustrate the movement of each tensioning member relative to first tension balancing member 1260.

Referring to FIG. 25, first driven tensioning member 1220 can translate through the loop formed by first tension balancing member 1260. Likewise, referring to FIG. 26, second driven tensioning member 1222 can translate through the loop formed by first tension balancing member 1260. This relative movement may increase the ability of tensioning system 1200 to adapt to variations in tension across instep portion 1160 and/or across article 1100. As described in further detail below and shown in FIG. 30, this arrangement facilitates balancing tension across instep portion 1160, in order to improve fit and comfort.

Figure 27:
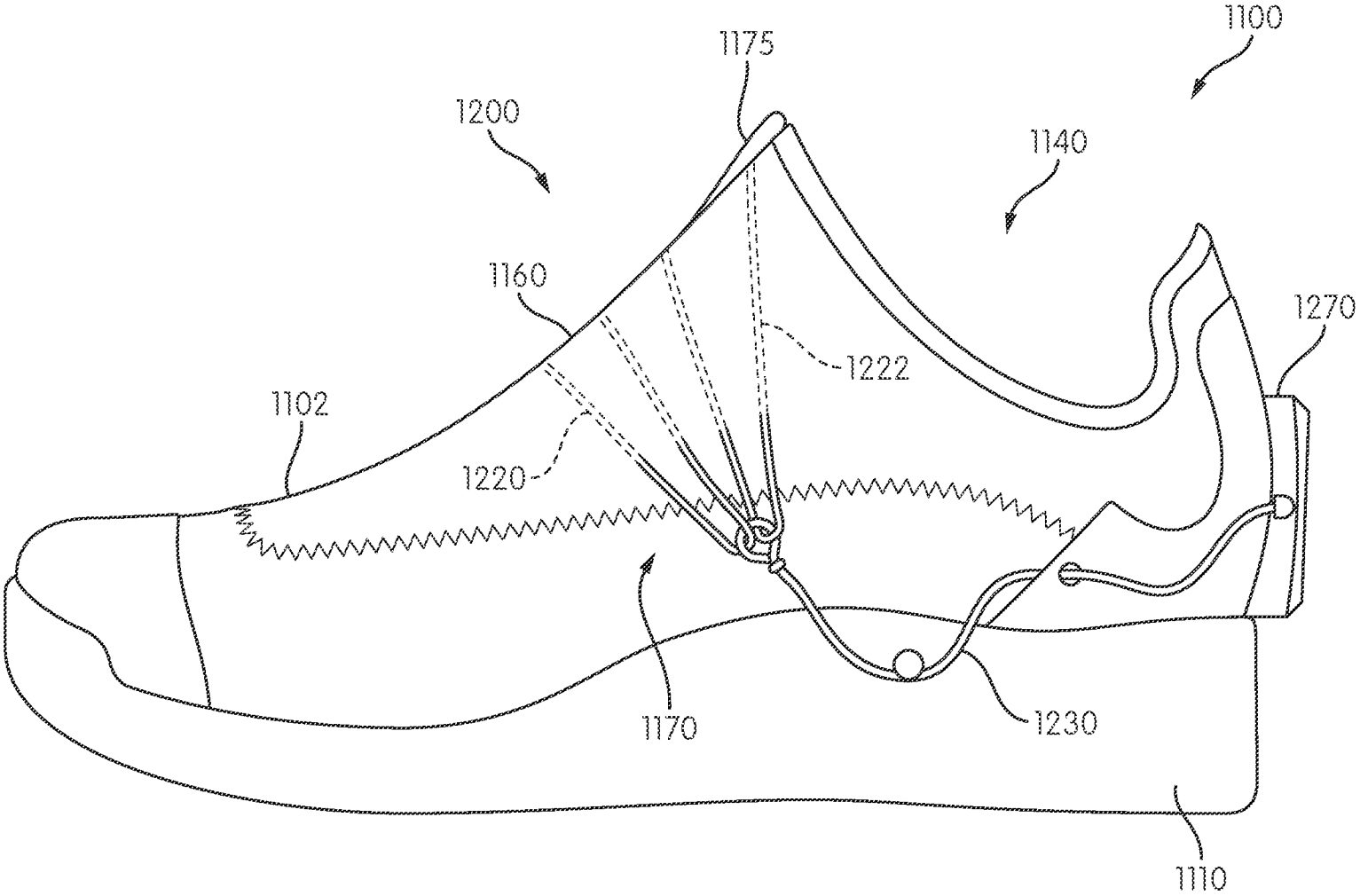
FIG. 27 is a schematic side view of the article of footwear of FIG. 21, in which the tensioning system is in a loosened configuration.
Figure 28:
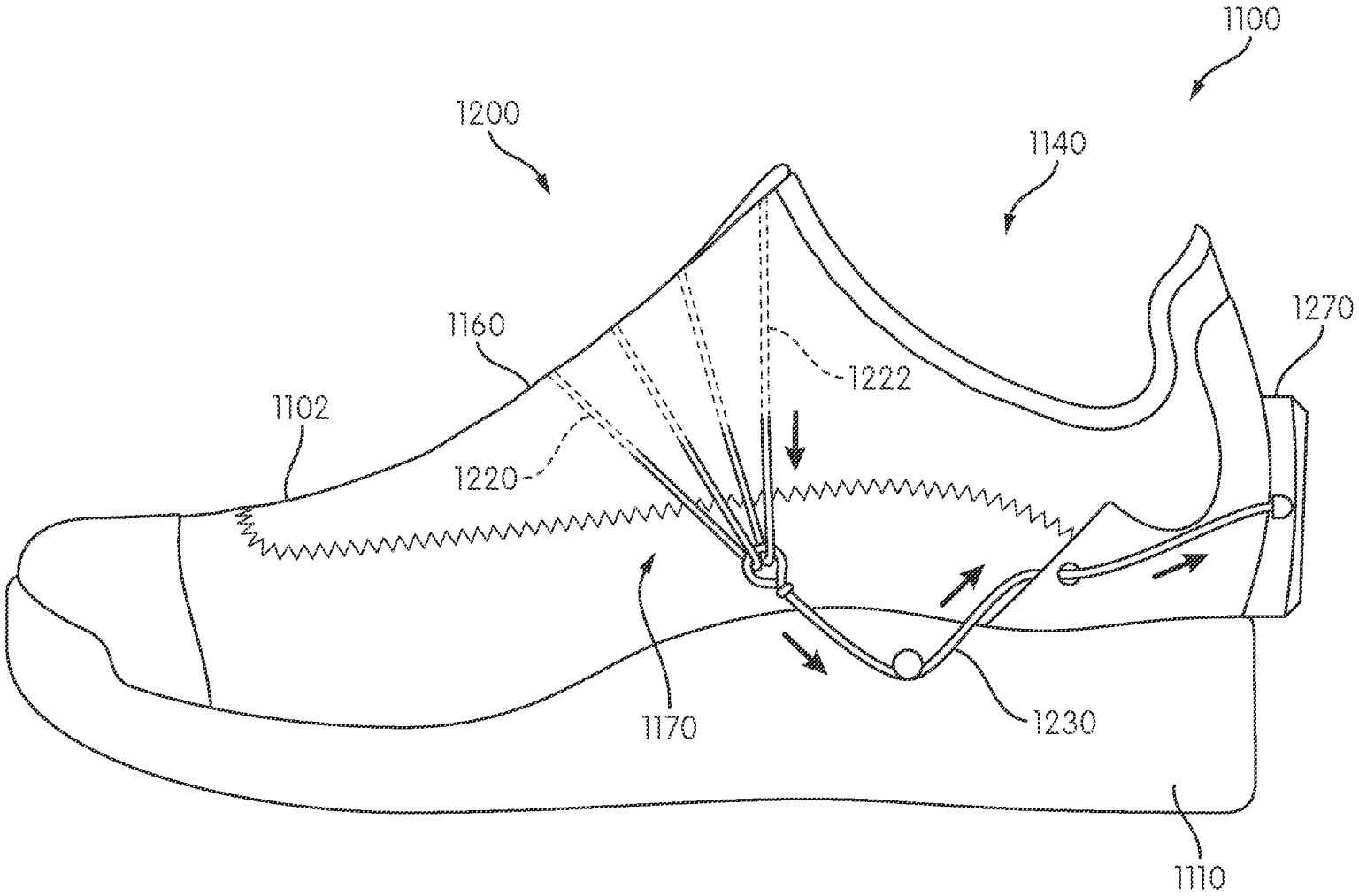
FIG. 28 is a schematic side view of the article of footwear of FIG. 21, in which the tensioning system is being actively tightened.
Figure 29:
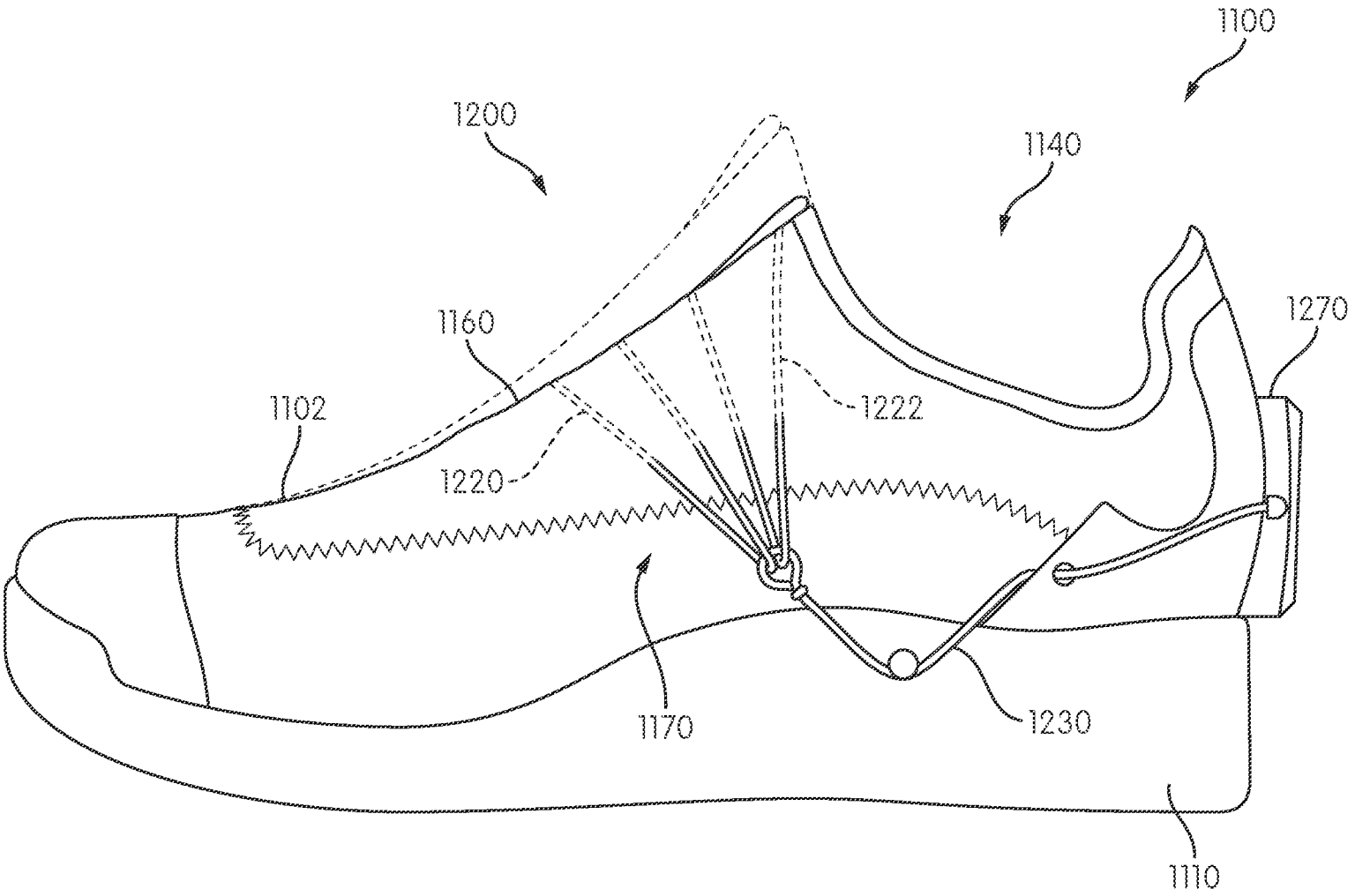
FIG. 29 is a schematic side view of the article of footwear of FIG. 21, in which the tensioning system is in a tightened configuration.

FIGS. 27-29 illustrate a sequence of fastening upper 1102 using tensioning system 1200, according to one embodiment. Initially, as seen in FIG. 27, upper 1102 may be fully open. In this case, instep portion 1160 is in an expanded configuration that allows for easy insertion of a foot. In some cases, instep portion 1160 could be further expanded, and opening 1140 further widened, by pulling on tab portion 1175.

Tightening of upper 1102 may be initiated in any manner. In some embodiments, a remote device may be used to signal tensioning device 1270 to begin tightening upper 1102. An exemplary remote device has been described above and shown in FIGS. 9-12, however other embodiments could utilize any other kinds of remote devices. Moreover, it will be understood that the kinds of controls discussed for the remote device of FIGS. 9-12 may be utilized to control tightening and/or loosening of upper 1102 in a similar manner. In still other embodiments, one or more control buttons could be incorporated directly into article 1100, such as on an outer casing of tensioning device 1270 or on the sidewalls of sole structure 1110. In such an embodiment, a user may simply touch the one or more control buttons to initiate tightening.

As seen in FIG. 28, with tensioning device 1270 activated, first driving tensioning member 1230 may be further retracted into tensioning device 1270. This results in increased tension being applied to first driven tensioning member 1220 and second driven tensioning member 1222. In a similar manner, second driving tensioning member 1232 may be retracted on an opposing side of article 1100, which acts to tension third driven tensioning member 1224 and fourth driven tensioning member 1226 (not shown). As the driven tensioning members are pulled by first driving tensioning member 1230 and second driving tensioning member 1232, the fixed ends of the driven tensioning members 1210 pull down on instep portion 1160 in order to fasten upper 1102 around the foot. For example, in the fully tightened configuration shown in FIG. 29, opening 1140 may be constricted in size and instep portion 1160 may be tightened against the top of a foot, when article 1100 is worn.

The change in tension that occurs in FIGS. 27-29 may result in a corresponding decrease in volume for intermediate covering portion 1170. Specifically, intermediate covering portion 1170 may be associated with a first volume in the loosened configuration for article 1100 shown in FIG. 27 and intermediate covering portion 1170 may be associated with a second volume in the tightened configuration for article 1100 shown in FIG. 29. In the exemplary embodiment, the second volume may be substantially less than the first volume, thereby creating a smaller interior cavity within upper 1102 in order to keep upper 1102 fastened around a foot.

Figure 30:
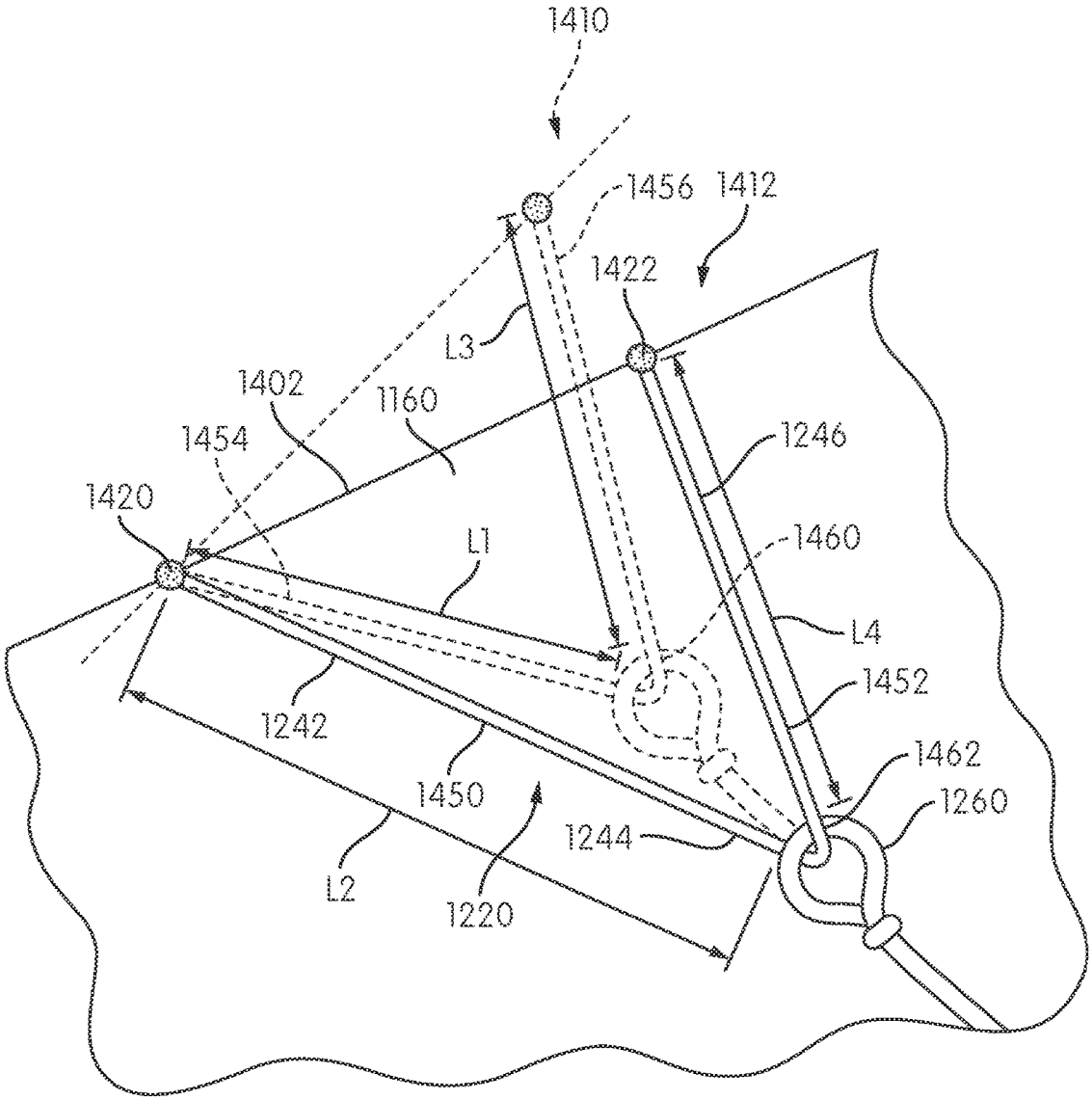
FIG. 30 is a schematic view of an embodiment of some components of a tensioning system.

FIG. 30 illustrates a schematic view of an embodiment of some components of tensioning system 1200, which highlights how tension balancing may be achieved in at least some embodiments. For purposes of clarity, only a single driven tensioning member is shown in FIG. 30. However, similar principles of operation may apply to any additional driven tensioning members that may be used in various embodiments.

Referring to FIG. 30, a top edge 1402 of instep portion 1160 is shown schematically in both an initial raised configuration 1410 (shown in phantom) and a final lowered configuration 1412. Additionally, first driven tensioning member 1220 is fixed to top edge 1402. Specifically, first portion 1242 is fixed to top edge 1402 at a first fixed point 1420 and third portion 1246 is fixed to top edge 1402 at a second fixed point 1422. Second portion 1244 is looped through first tension balancing member 1260 such that first tension balancing member 1260 can slide along the length of first driven tensioning member 1220.

The raised configuration 1410 of top edge 1402 may be associated with a loosened configuration for instep portion 1160 while the lowered configuration 1412 of top edge 1402 may be associated with a tightened configuration for instep portion 1160. As seen in FIG. 30, first tension balancing member 1260 may move to different locations along the length of first driven tensioning member 1220 as the tension is adjusted. This movement results in different lengths for the segments of first driven tensioning member 1220 that extend from first tension balancing member 1260 to top edge 1402. Specifically, the length of a first segment of first driven tensioning member 1220 that extends between first tension balancing member 1260 and first fixed point 1420 changes. Also, the length of a second segment of first driven tensioning member 1220 that extends between first tension balancing member 1260 and second fixed point 1422 changes.

For example, in the configuration shown in FIG. 30, with top edge 1402 in raised configuration 1410 (indicated in phantom), first tension balancing member 1260 is positioned at a first location 1460 of first driven tensioning member 1220. In this configuration, first driven tensioning member 1220 is divided into a segment 1454 that extends between first tension balancing member 1260 and first fixed point 1420 and into a segment 1456 that extends between first tension balancing member 1260 and second fixed point 1422. As indicated in FIG. 30, segment 1454 is associated with a length L1 and segment 1456 is associated with a length L3. Moreover, in this exemplary configuration, length L1 is seen to be approximately equal to length L3. As top edge 1402 moves to lowered configuration 1412, however, first tension balancing member 1260 moves to a second location 1462 along the length of first driven tensioning member 1220. In this configuration, first driven tensioning member 1220 is divided into a segment 1450 that extends between first tension balancing member 1260 and first fixed point 1420 and into a segment 1452 that extends between first tension balancing member 1260 and second fixed point 1422. As indicated in FIG. 30, segment 1450 is associated with a length L2 and segment 1456 is associated with a length L4. Moreover, in this exemplary configuration, length L2 is seen to be substantially greater than length L4. As the lengths of these different segments of first driven tensioning member 1220 are varied, the tension applied to instep portion 1160 at first fixed point 1420 and second fixed point 1422 can be adjusted. It can therefore be seen that this tensioning system allows first tension balancing member 1260 to move to different locations along the length of first driven tensioning member 1220 in order to more evenly distribute loads across different portions of upper 1102.

Figure 31:
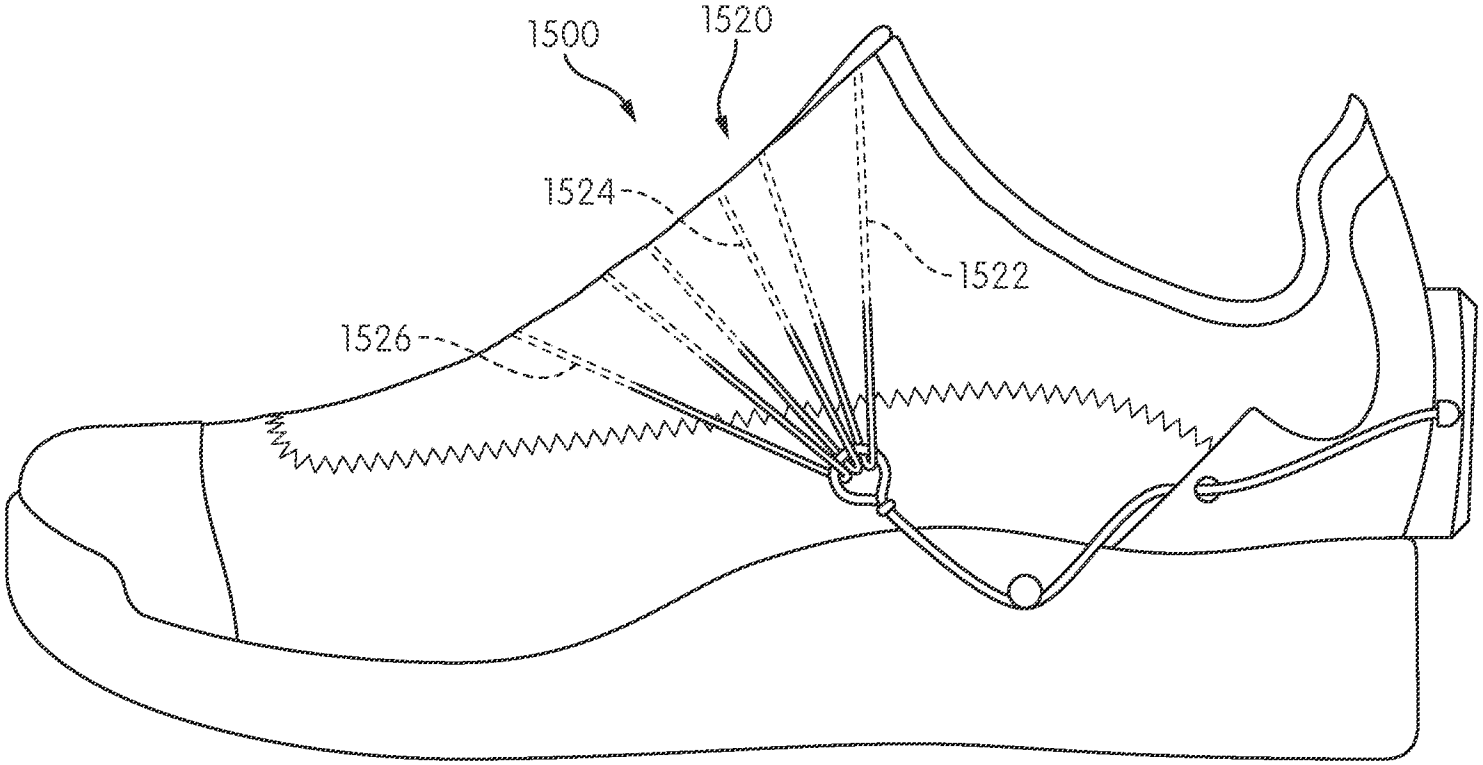
FIG. 31 is a schematic side view of an embodiment of an article of footwear with a tensioning system.
Figure 32:
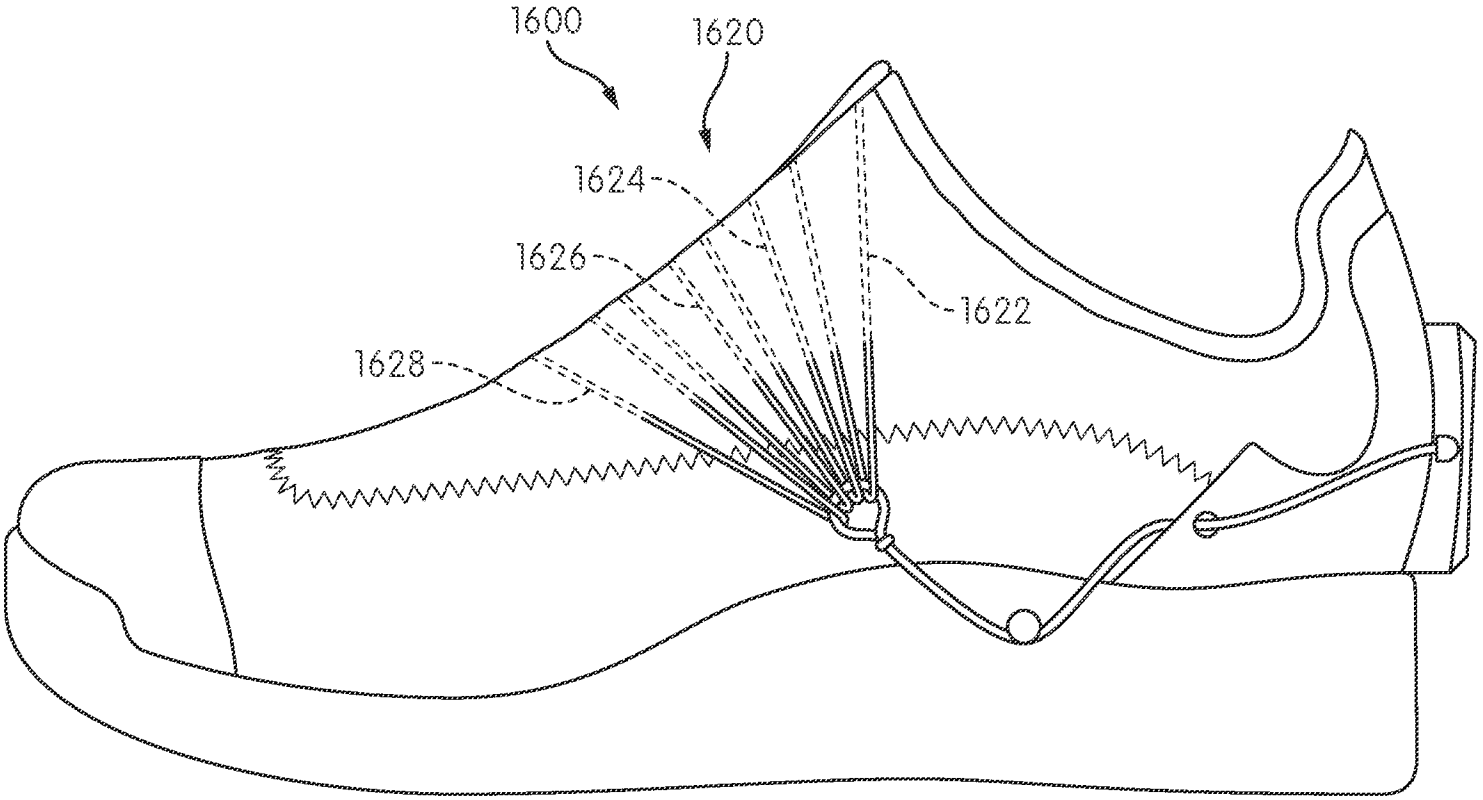
FIG. 32 is a schematic side view of an embodiment of an article of footwear with a tensioning system.

It will be understood that embodiments can include any number of tensioning members, including both driven tensioning members and driving tensioning members. Although the exemplary embodiment illustrates a configuration having two driven tensioning members on each side of the upper, other embodiments could utilize a single driven tensioning member on each side. Still other embodiments could use more than two driven tensioning members on each side. For example, FIG. 31 illustrates the side view of an embodiment that includes three different driven tensioning members on each side. Referring to FIG. 31, article 1500 includes a tensioning system 1520 including a first driven tensioning member 1522, second driven tensioning member 1524 and third driven tensioning member 1526 on a side of article 1500. Although not shown, article 1500 may include a corresponding set of three driven tensioning members on an opposing side. As another example, FIG. 32 illustrates the side view of an embodiment that includes four different driven tensioning members on each side. Referring to FIG. 32, article 1600 includes a tensioning system 1620 including a first driven tensioning member 1622, second driven tensioning member 1624, third driven tensioning member 1626 and a fourth driven tensioning member 1628 on a side of article 1600. In some embodiments, using additional driven tensioning members may increase the surface area of the article that can be directly tensioned.

Figure 33:
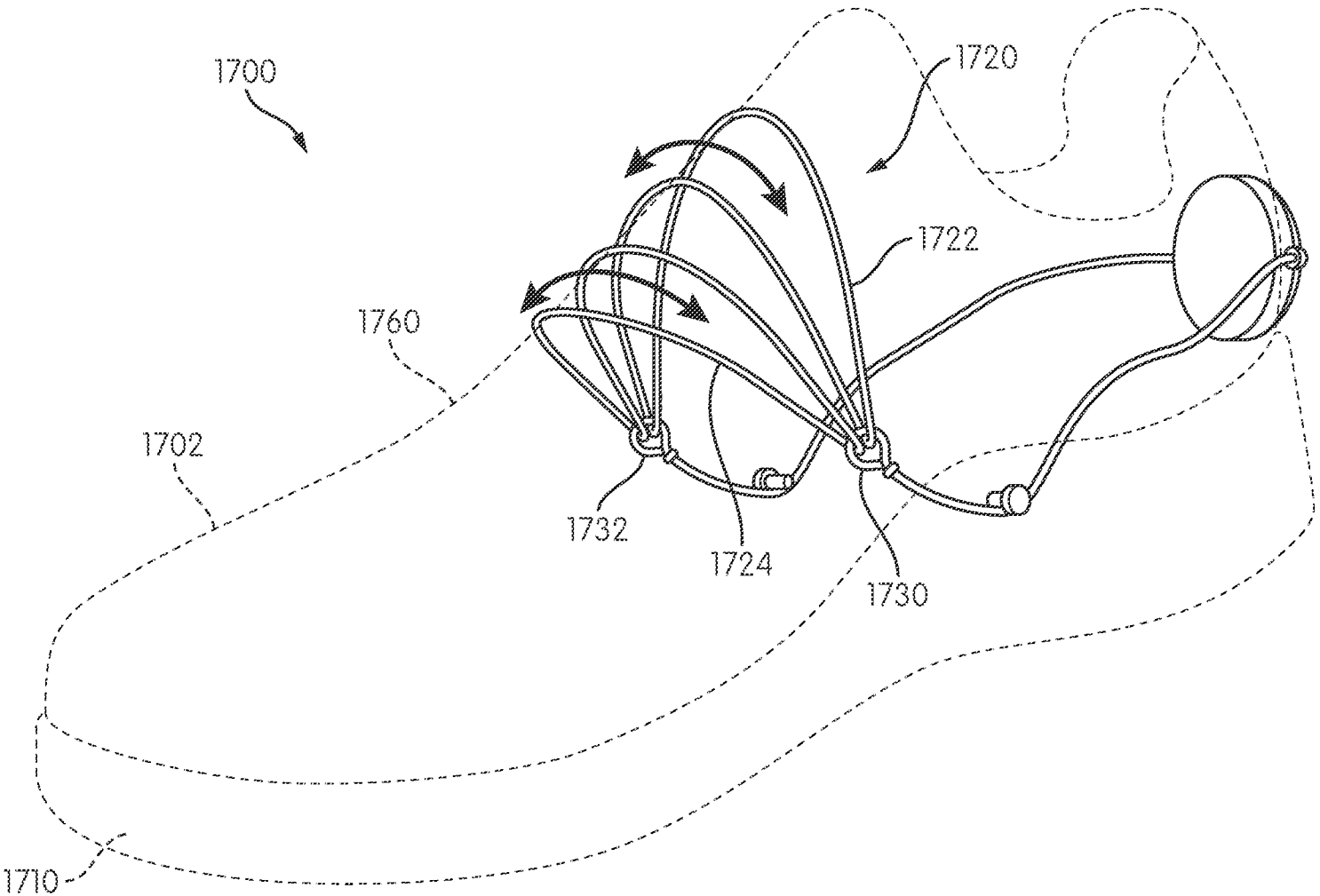
FIG. 33 is a schematic isometric view of an embodiment of an article of footwear with a tensioning system, in which the upper and sole structure are shown in phantom.

FIG. 33 illustrates a schematic isometric view of an embodiment of an article of footwear 1700. For purposes of illustration, upper 1702 and sole structure 1710 of article 1700 are shown in phantom. Article 1700 may include tensioning system 1720. In some embodiments, tensioning system 1720 includes driven tensioning members that extend over instep portion 1760. Specifically, a first driven tensioning member 1722 extends from a first tension balancing member 1730 to a second tension balancing member 1732 on an opposing side of article 1700. Likewise, a second driven tensioning member 1724 also extends from first tension balancing member 1730 to second tension balancing member 1732. This configuration may allow for tensioning forces to be transferred between tension balancing members on opposing sides of article 1700.

Figure 34:
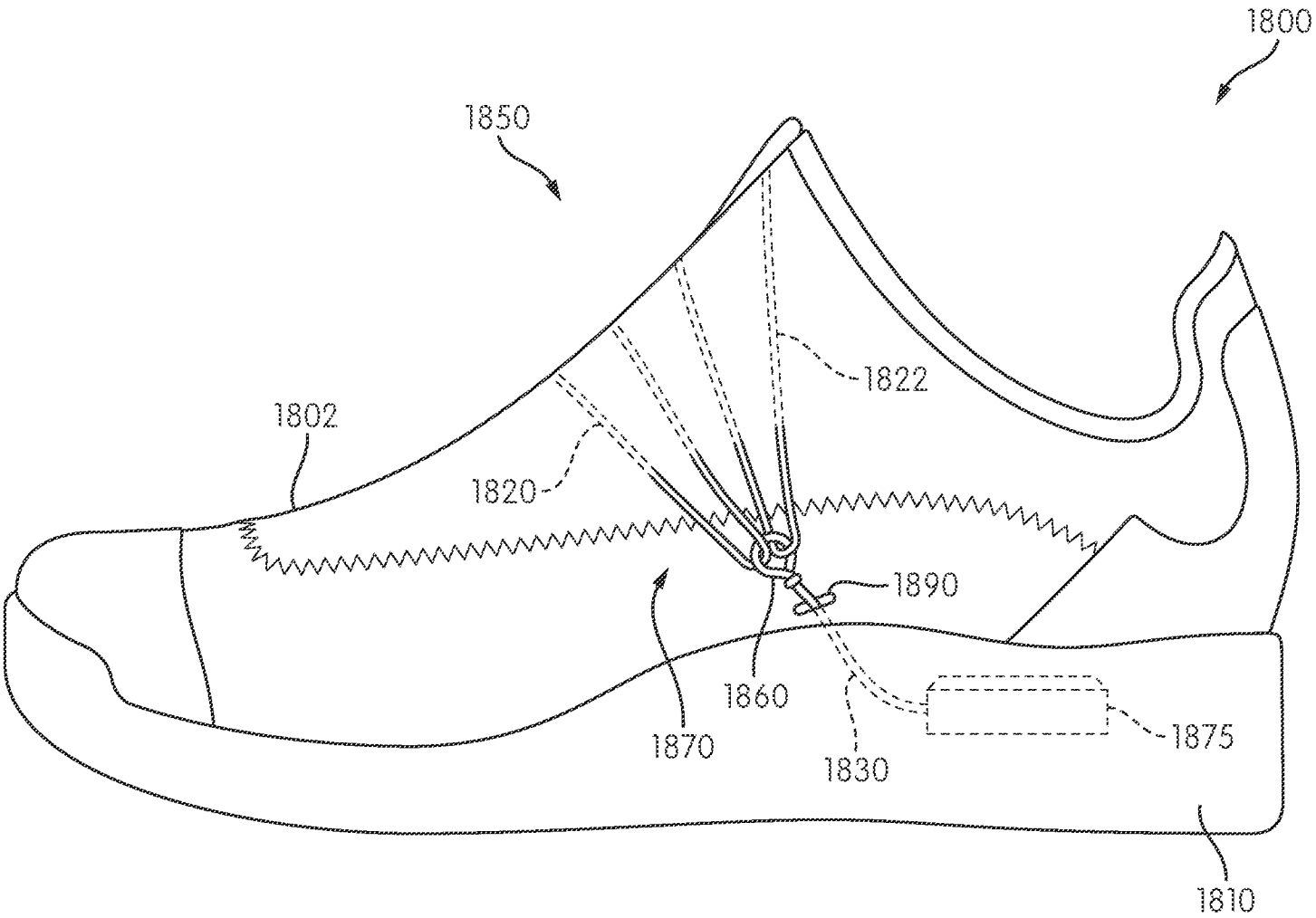
FIG. 34 is a schematic side view of another embodiment of an article of footwear with a tensioning system.

FIG. 34 illustrates a schematic side view of an embodiment of article of footwear 1800, also referred to simply as article 1800. It will be understood that article of footwear 1800 may be configured with any of the provisions, features, systems and/or components which have already been described in previous embodiments and shown in FIGS. 1-33. For purposes of clarity, some of these features may be discussed with respect to the embodiment shown in FIG. 34, but not all features may be discussed. However, any of the features discussed in each embodiment of the disclosure could be optionally part of any other embodiment, such that features of different embodiments can be combined in any manner.

In the embodiment of FIG. 34, article 1800 includes upper 1802 and sole structure 1810. Upper 1802 may further include an intermediate covering portion 1870, which may be similar in some respects to intermediate covering portion 1170 discussed above and shown in FIGS. 21-30. Moreover, article 1800 includes tensioning system 1850 with a first driven tensioning member 1820 and a second driven tensioning member 1822. Tensioning system 1850 may also include driving tensioning member 1830. In a similar manner to the embodiments of FIGS. 21-30, first driven tensioning member 1820 and second driven tensioning member 1822 may be coupled to driving tensioning member 1830 via tension balancing member 1860.

With this arrangement, as portions of article 1800 are expanded and contracted in response to changes in tension of various tensioning members, the interior volume of intermediate covering portion 1870 may generally change accordingly. Thus, for example, as portions of article 1800 contract with increased tension, the interior volume of intermediate covering portion 1870 may decrease. Likewise, as portions of article 1800 expand with decreased tension, the interior volume of intermediate covering portion 1870 may increase.

In contrast to at least some previous embodiments, the embodiment shown in FIG. 34 incorporates a tensioning device 1875 into sole structure 1810. Tensioning device 1875 could be any kind of device used for applying tension to one or more tensioning members, such as driving tensioning member 1830. For purposes of clarity, tensioning device 1875 is shown schematically in the current embodiments. However, tensioning device 1875 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Moreover, tensioning device 1875 could include any provisions disclosed above for tensioning device 1270 and/or tensioning device 220. In an exemplary embodiment, tensioning device 1875 could be a reel or spool that automatically winds in response to commands from a remote device and/or sensor information.

As seen in FIG. 34, in at least some embodiments, tensioning device 1875 is disposed within sole structure 1810. For example, tensioning device 1875 could be disposed in a cavity of sole structure 1810. Portions of driving tensioning member 1830 may attach to tensioning device 1875 (e.g., wind onto a reel or spool of tensioning device 1875). A portion of driving tensioning member 1830 may extend through sole structure 1810 and along an interior side of upper 1802, before exiting an opening 1890 in upper 1802. After exiting opening 1890, a portion of driving tensioning member 1830 may be attached to tension balancing member 1860. The exemplary arrangement allows tensioning device 1875 to be housed within sole structure 1810, thereby helping to protect tensioning device 1875.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper having a toe covering portion and an entry hole for receiving a foot;

an intermediate covering portion disposed between the toe covering portion and the entry hole, wherein the intermediate covering portion is adapted to be closed around an instep of the foot and wherein a volume of the intermediate covering portion is variable;

a first driven tensioning member having a first portion, a second portion and a third portion, wherein:

the first portion extends through a channel formed in the intermediate covering portion, the channel extending horizontally with respect to the intermediate covering portion;

the third portion extends through the channel in the intermediate covering portion;

the second portion is disposed between the first portion and the third portion;

a driving tensioning member having a first end portion defining a tension balancing member comprising a looped end of the driving tensioning member, and the driving tensioning member having a second end portion;

wherein the second portion of the first driven tensioning member is engaged with the tension balancing member such that the second portion can move with respect to the tension balancing member; and wherein increasing the tension of the driving tensioning member results in increased tension in the first driven tensioning member, which substantially decreases the volume of the intermediate covering portion.

2. The article of footwear according to claim 1, wherein the first driven tensioning member is disposed through the looped end of the driving tensioning member.

3. The article of footwear according to claim 1, wherein the second end of the driving tensioning member is attached to a tensioning device.

4. The article of footwear according to claim 1, wherein the article of footwear includes a second driven tensioning member, and wherein the second driven tensioning member is engaged with the tension balancing member.

5. The article of footwear according to claim 4, wherein the first driven tensioning member has two ends fixed to the intermediate covering portion and wherein the driving tensioning member has two ends fixed to the intermediate covering portion.

6. An article of footwear, comprising:

an upper having a toe covering portion and an entry hole for receiving a foot;

an intermediate covering portion disposed between the toe covering portion and the entry hole, wherein the intermediate covering portion is adapted to be closed around an instep of the foot and wherein a volume of the intermediate covering portion is variable;

a reel tensioning device;

a first driven tensioning member extending through a channel formed in the intermediate covering portion, the channel extending horizontally with respect to the intermediate covering portion;

a driving tensioning member having a first end portion configured as a loop portion and a second end portion associated with the reel tensioning device;

wherein the first driven tensioning member is disposed through the loop portion such that the first driven tensioning member can translate through the loop portion;

wherein the loop portion transfers tension between the first driven tensioning member and the driving tensioning member; and wherein the volume of the intermediate covering portion is decreased when the reel tensioning device is actuated to increase tension in the driving tensioning member.

7. The article of footwear according to claim 6, wherein the reel tensioning device is mounted to the upper.

8. The article of footwear according to claim 7, wherein the reel tensioning device is mounted at a heel portion of the upper.

9. The article of footwear according to claim 6, wherein the driving tensioning member extends from the intermediate covering portion to a guide member attached to a sole structure of the article of footwear.

10. The article of footwear according to claim 9, wherein the driving tensioning member extends from the guide member to an aperture associated with the upper.

11. The article of footwear according to claim 10, wherein the driving tensioning member extends from the aperture to the reel tensioning device.

12. The article of footwear according to claim 6, wherein at least two tensioning members are disposed through the loop portion.

13. An article of footwear, comprising:

an upper including a closed instep portion;

a tensioning system, further comprising:

a first driven tensioning member associated with a first side of the upper and a first driving tensioning member associated with the first side of the upper, the first driving tensioning member being attached to the instep portion and extending through a channel formed in the upper, the channel extending horizontally with respect to the upper;

a second driven tensioning member associated with a second side of the upper and a second driving tensioning member associated with the second side of the upper, the second driving tensioning member being attached to the instep portion;

wherein a first end portion of the first driving tensioning memberdefining a first tensioning balancing member comprising a looped end of the first driving tensioning member, and wherein the first driven tensioning member is engaged with the first tensioning balancing member, wherein the first tension balancing member can transfer tension between the first driving tensioning member and the first driven tensioning member and wherein the first driven tensioning member can move with respect to the first tension balancing member;

wherein a first end portion of the second driving tensioning member defining a second tension balancing member comprising a looped end of the second driving tensioning member, and wherein the second driven tensioning member is engaged with the second tension balancing member, wherein the second tension balancing member can transfer tension between the second driving tensioning member and the second driven tensioning member, and wherein the second driven tensioning member can move with respect to the second tension balancing member;

wherein a second end portion of the first driving tensioning member is attached to a tensioning device and wherein a second end portion of the second driving tensioning member is attached to the tensioning device; and wherein increasing tension in the first driving tensioning member and the second driving tensioning member using the tensioning device pulls the first driven tensioning member and the second driven tensioning member and wherein pulling the first driven tensioning member and the second driven tensioning member fastens the instep portion of the upper.

14. The article of footwear according to claim 13, wherein a first portion of the first driven tensioning member is attached to the instep portion of the upper and wherein a second portion of the first driven tensioning member is attached to the instep portion of the upper.

15. The article of footwear according to claim 14, wherein the first driven tensioning member includes a third portion that is disposed between the first portion and the second portion and wherein the third portion is in contact with the first tension balancing member.

16. The article of footwear according to claim 15, wherein the looped end can slide along the third portion of the first driven tensioning portion.

17. The article of footwear according to claim 14, wherein the first portion of the first driven tensioning member is attached to a top edge of the instep portion and wherein the second portion of the first driven tensioning member is attached to the top edge.

18. The article of footwear according to claim 13, wherein at least two driven tensioning members are engaged with the first tension balancing member on the first side and wherein at least two driven tensioning members are engaged with the second tension balancing member on the second side.

* * * * *